US005738967A

United States Patent [19]

Horii et al.

[11] Patent Number: 5,738,967

[45] Date of Patent: Apr. 14, 1998

[54] METHOD OF LIQUID ELECTROPHOTOGRAPHY BY IMPRESSION/CONTACT DEVELOPMENT

[75] Inventors: Shinichi Horii; Hiroshi Tokunaga; Katusyuki Ogura; Yoshihiro Nishio, all of Tokyo, Japan

[73] Assignee: Sony Corporation, Tokyo, Japan

[21] Appl. No.: 699,324

[22] Filed: Aug. 19, 1996

[30] Foreign Application Priority Data

Aug. 22, 1995 [JP] Japan ..... 7-213389

[51] Int. Cl.[6] ..... G03G 15/10

[52] U.S. Cl. ..... 430/119

[58] Field of Search ..... 430/115, 117, 430/118, 119

[56] References Cited

U.S. PATENT DOCUMENTS

| | | | |
|---|---|---|---|
| 4,021,586 | 5/1977 | Matkan | 427/17 |
| 4,325,627 | 4/1982 | Swidler et al. | 430/118 |
| 4,891,286 | 1/1990 | Gibson | 430/115 |
| 5,477,313 | 12/1995 | Kuramochi | 355/256 |

FOREIGN PATENT DOCUMENTS

| | | |
|---|---|---|
| 0246066 | 11/1987 | European Pat. Off. . |
| 0250098 | 12/1987 | European Pat. Off. . |
| 57-185463 | 11/1982 | Japan . |
| 63-74083 | 4/1988 | Japan . |
| 9301531 | 1/1993 | WIPO . |

*Primary Examiner*—John Goodrow
*Attorney, Agent, or Firm*—Jay H. Maioli

[57] ABSTRACT

A developing method expediting the development process, eliminates squeezing and achieves both high-speed development and uniform development at a half tone density. The development method employs a liquid developer 50 comprised of charged toner particles dispersed in an electrically insulating liquid. The charged toner particles are made up at least of a coloring agent and a resin. The liquid developer 50 is uniformly deposited on the surface of the developer carrier 51 and an electrical field is impressed for generating a liquid toner layer comprised of the charged toner particles assembled together. A charge carrier 55 on which is formed an electrostatic latent image is contacted under pressure with the developer carrier 51 holding the liquid toner layer comprised of the charged toner particles assembled together in order to effect development.

8 Claims, 16 Drawing Sheets

METHOD OF LIQUID ELECTROPHOTOGRAPHY BY IMPRESSION/CONTACT DEVELOPMENT

BACKGROUND OF THE INVENTION

1. Field of the Invention

This invention relates to a developing method employed in an image forming method of the electrophotography system. More particularly, it relates to a developing method employing a liquid developer.

2. Description of the Related Art

Heretofore, in a variety of printers and duplicators, an electrophotography system (so-called Carlson process) is adopted extensively as a system for image formation. With the electrophotography system, an image is formed on a recording sheet through a process of electric charging—light exposure—development—transfer—separation. The charge carrier, on which a photoconductive layer has been formed, has its surface uniformly charged to, for example, a negative polarity. In the next light exposure step, laser light irradiation based on image signals is done by, for example, a semiconductor laser, whereby the minus charges are decreased or disappear in an exposed portion to form an electrostatic latent image on the surface of the recording sheet.

After an electrostatic latent image has been formed on the surface of a charge carrier, a developer is supplied during the developing process so that a developer image is formed on the surface of an area corresponding to the electrostatic latent image. During the development process, the image is developed by, for example, an electrophoretic developing method employing a liquid developer.

The conventional electrophoretic development method is now explained by referring to FIGS. 1 and 2 showing the states before and after formation of the developer image, respectively.

In this electrophoretic developing method, a charge carrier 104, having an electrostatic latent image 103 formed on its surface, is brought close to a developer carrier 102 of a metal plate carrying a liquid developer 101. A pre-set electrical voltage is applied across the developer carrier 102 and the charge carrier 104 so that a pre-set difference in electrical potential will be present across the developer carrier 102 relative to the electrostatic latent image 103 on the charge carrier 104. The voltage applied across the developer carrier 102 and the charge carrier 104 is set at a proper value for preventing the carrier texture from becoming roughed. This will occur for example, if, with the developer carrier 102 and the charge carrier 104 lying close to each other, a pre-set voltage is applied across the developer carrier 102 or the charge carrier 104, a developing electrical field 105 is formed between the liquid developer 101 on the developer carrier 102 and the electrostatic latent image 103 on the charge carrier 104.

Charged toner particles 106 on the liquid developer 101 are migrated in this manner from the developer carrier 102 towards the electrostatic latent image 103 on the charge carrier 104 by the electrical potential difference across the developer carrier 102 and the electrostatic latent image 103 on the charge carrier 104. This is the sum of the electrophoretic developing method. The charged toner particles 106, migrated towards the electrostatic latent image 103, are attracted by the electrostatic latent image 103 and deposited thereon to form a developed toner layer 107. The charge carrier 104 is peeled from the developer carrier 102 with the charged toner particles 108 in the developed toner layer 107 affixed thereto, as shown in FIG. 2. This forms the developed toner layer 107 in an area registering with an area where the electrostatic latent image 103 on the charge carrier 104 has been formed. This indicates that a developed image is formed in register with the electrostatic latent image 103.

However, with the above-described conventional developing method, since the charged toner particles 106 are migrated during development in the developing electrical field 105 by electrophoresis, the developing time is prolonged by a time interval corresponding to the time duration of electrophoresis. Thus, with the conventional developing method, it has been difficult to achieve development at a high speed.

For achieving high speed development, it may be contemplated to supply a large quantity of the liquid developer 101 to the developing electrical field 105 or to supply the high-density liquid developer 101 to the developing electrical field 105. However, if a large quantity of the liquid developer 101 has to be supplied to the developing electrical field 105, the developing device is increased in size. In addition, if the high-density liquid developer 101 is used, excess charged toner particles other than the charged toner particles 108 in the developed toner layer 107, become affixed to cause roughening of the texture and deposition of excess toner particles 109 to an image area.

Furthermore, in the electrophoretic development method, an excess liquid developer layer is formed on the charge carrier 104. The result is that a squeezer unit for removing the excess developer needs to be provided downstream of the developing unit, thus complicating and increasing the size of the development device. As the squeezer unit, an air knife squeezer, corona squeezer or a reversing roller squeezer are generally used.

Moreover, if a uniform image of a halftone density is to be obtained by the electrophoretic development method, it is necessary to perform development with the liquid developer 101 in a standstill state for eliminating adverse effects of flow pattern fluctuations in the liquid developer 101. This, however, is incompatible with a high-speed developing operation.

The present inventors have conducted perseverant research towards finding a method for producing an image superior in graininess and uniformity in halftone density despite high development speed employed, and have arrived at a novel development method consisting of preliminary forming a liquid toner layer comprised of charged toner particles collected on the developer carrier and subsequently contacting the charge carrier with the liquid toner layer for development.

SUMMARY OF THE INVENTION

It is therefore an object of the present invention to provide a developing method employing liquid developer whereby the developing speed may be increased and the squeezing operation may be eliminated while uniform development with halftone density may be achieved in congruity with the high developing speed.

The present invention provides a development method employing a liquid developer comprised of charged toner particles dispersed in an electrically insulating liquid. The charged toner particles are made up at least of a coloring agent and a resin. The liquid developer is uniformly deposited on the surface of the developer carrier and an electrical field is impressed for generating a liquid toner layer comprised of the charged toner particles assembled together. A charge carrier on which is formed an electrostatic latent image is contacted under pressure with the developer carrier holding the liquid toner layer comprised of the charged toner particles assembled together in order to effect development. The charged toner particles, forming the liquid toner layer comprised of the charged toner particles assembled together, are separated depending on the direction of the electrical field formed between the developer carrier and the charge carrier for forming a developed image corresponding to the latent image on the charge carrier.

For forming the liquid toner layer comprised of charged toner particles assembled together on the developer carrier, uniform deposition of the liquid developing agent on the developer carrier and electrical field impression are carried out simultaneously or sequentially.

With the development method employing the liquid developer according to the present invention, the liquid developer is deposited on the developer carrier in the liquid toner forming step, and an electrical field is impressed across the liquid developer for forming a liquid toner layer comprised of the charged toner particles assembled together. In the development step next to the liquid toner forming step, a charge carrier is contacted under pressure with the developer carrier on which the liquid toner layer has been formed in order to effect development. That is, in the liquid toner forming step, previous to the development step, there is formed the liquid toner layer comprised of the charged toner particles assembled together. Thus, during the development step, there is no necessity of migration of the charged particles by electrophoresis, so that development can be expedited by a time corresponding to the migration of the charged particles.

Moreover, with the development method employing the liquid developer, since the liquid toner layer comprised of charged toner particles assembled together is first formed on the developer carrier and subsequently contacted under pressure with the charge carrier, no excess liquid developer layer is formed on the charge carrier, thus eliminating the squeezing operation for the excess liquid developer layer required in the conventional electrophoretic development method.

In addition, with the development method employing the liquid developer, if the liquid toner layer comprised of charged toner particles assembled together is formed on the developer carrier, the liquid toner layer comprised of charged toner particles assembled together are separated by pressure contact depending on the direction of the electrical field formed in the charged particle layer comprised of the charged toner particles assembled together, so that the charged toner particles faithfully corresponding to the charge density on the charge carrier may be developed, thus achieving a developed image with uniform halftone density.

Furthermore, with the development method employing the liquid developer, it is sufficient if the liquid toner layer comprised of charged toner particles assembled together is formed on the developer carrier, and there is no risk of carrier texture pollution or excessive deposition of the charged toner particles on an image area such as are encountered with the conventional electrophoretic development, even if the density of the charged toner particles of the liquid developer employed is higher, thus enabling the use of a high-density liquid developer.

Therefore, with the development method employing the liquid developer, the development process may be expedited, while the squeezing operation may be eliminated and both the graininess and uniformity of the halftone density may be achieved easily. Since the high-density liquid developer may be used, a high definition image of liquid development may be realized easily on a small-sized developing unit.

DETAILED DESCRIPTION OF THE PREFERRED EMBODIMENTS

Figure 1:
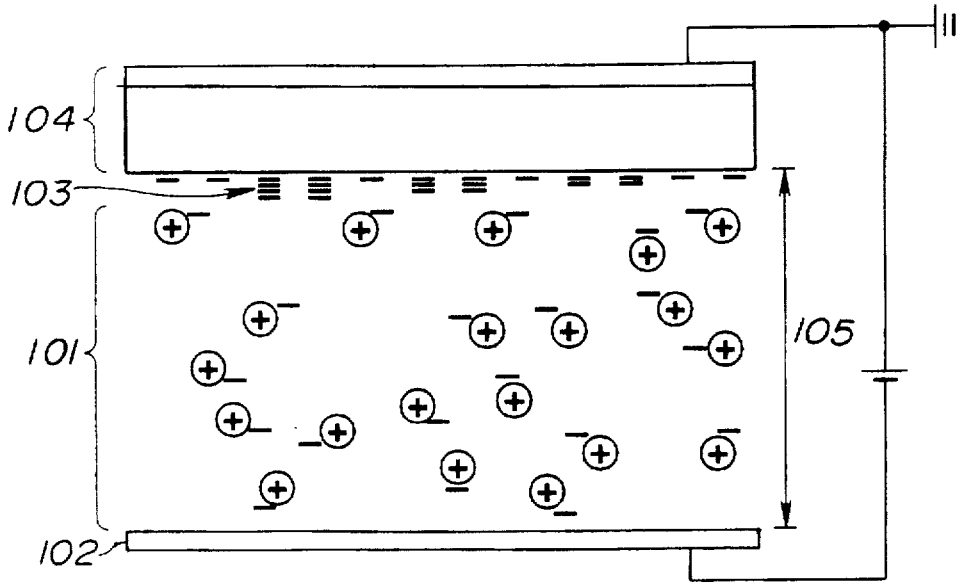
FIG. 1 shows the state in which a developer image is formed on a charge carrier by the developing method employing a liquid developer.
Figure 2:
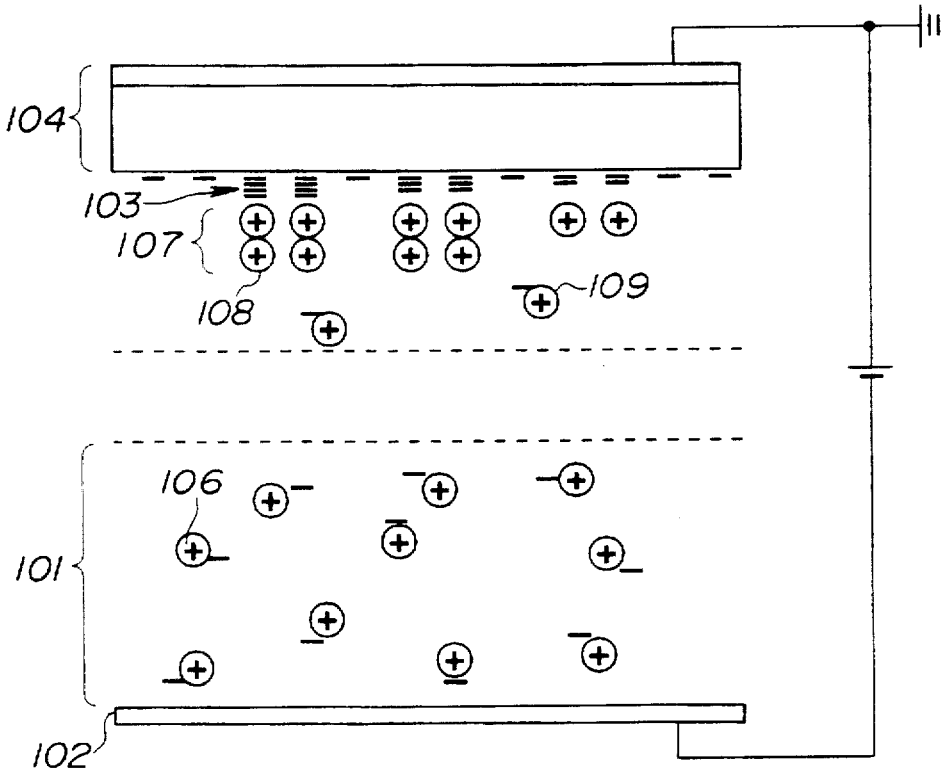
FIG. 2 shows a state in which a developer image formed on the charge carrier by the developing method employing a conventional liquid developer.

Referring to the drawings, the principle, experimental examples and preferred embodiments of the present invention will be explained in detail.

The development method of the present invention employing the liquid developer has a liquid toner layer forming step and a development step. The liquid toner layer herein means such a liquid toner layer produced by charged toner particles assembled together.

The liquid developer employed in the present invention is first explained. For the liquid developer, such a liquid developer is used in which a coloring agent and a dispersant are uniformly dispersed in an aliphatic hydrocarbonic solvent which is an electrically insulating organic substance. The toner particles dispersed in the liquid developer are uniformly charged to a positive or negative polarity.

As for the liquid developer employed in the present invention, any known types of liquid developers may be used without limitations if the liquid developer used is comprised of a dispersion in an electrically insulating medium of toner particles having a resistance value sufficient to maintain a desired potential at the time of the development. The coloring agents suitable for the liquid developer may be enumerated by such coloring agents comprised of pigments and/or dyes dispersed in a resin insoluble for an electrically insulating medium and such coloring agents comprised of pigments on the surfaces of which an organic material is directly reacted to form a coating using a coupling agent or the like.

Examples of the pigments and/or the dyes include known inorganic pigments, organic pigments, dyes and mixtures thereof.

The inorganic pigments may be enumerated by chromium-based pigments, cadmium-based pigments, iron-based pigments, cobalt-based pigments, Ultramarine and Prussian Blue.

The organic pigments and dyes may be enumerated by Hansa Yellow, Benzin Yellow G, Benzin orange, Fast Red, Brilliant Carmine 3B, Brilliant Carmine 6B, Phtahlocyanine Blue, Victoria Blue, Spirit Black, Oil Black, Oil Blue, Alkali Blue, Fast Scarlet Rhodamine 6B, Rhodamine Lake, Fast Sky Blue, Nigrosin, and carbon black. These may be used singly or in combination.

The above-mentioned resins of the coloring agent insoluble in the electrically insulating medium may be enumerated by, for example, styrenic resins manufactured by ESSO CHEMICALS INC. under the trade name of VICOSTIC A75, D75 or D100; maleic acid based resins, manufactured by ARAKAWA KAGAKU KOGYO SHA under the trade name of ESTERGUM M-90, M-100, or Marquid Nos.1, 2, 5, 6 or 8, or manufactured by Dainippon Ink and Chemicals, incorporated under the trade name of BECKACITE 1100 and 1123, F-231 and 1120; phenolic resins manufactured by Dainippon Ink and Chemicals, Incorporated under the trade name of SUPER BECKACITE 1011, 3011 and BECHASITE 1100 AND 1123; epoxy resins manufactured by Dainippon Ink and Chemicals, Incorporated under the trade name of EPICRON 1050, 4055 and 7050, or manufactured by SHELL PETROLEUM INC. under the trade name of EPICOAT 1001, 1004 and 1007; ketone resins manufactured by TOA GOSEI KAGAKU KOGYO KK under the trade name of ARON KR-SS, butyral resins manufactured by SEKISUI KAGAKU KOGYO KK under the trade name of ETHREC BM-1 and BM-2; mathacrylic resins manufactured by MITSUBISHI RAYON SHA under the trade name of DIANAL BE-64, 77, 85, 90 and 106; and polyester resins. These may be used singly or in combination.

For dispersing the pigments and/or the dyes in a resin insoluble in the electrically insulating medium, the pigments and/or the dyes may be melt-mixed with the resin insoluble in the electrically insulating media, or the pigments and/or the dyes may be flashed with the media insoluble in the electrically insulating resin.

The electrically insulating media for the liquid developer so far known in the liquid developer may be employed. Such electrically insulating media may be hexane, pentane, octane, nonane, decane, undecane or dodecane. In addition, the media may be a variety of aliphatic hydrocarbonic solvents boiling at 100° C. to 250° C. and having specific volume resistance of not lower than $10^9$ ohm/cm and a dielectric constant less than 3, such as organic solvents manufactured by EXXON CHEMICALS INC. under the trade name of ISOPER G, H, K, L and M. The electrically insulating media may also be such a medium which is solid at room temperature and which is liquified on heating, such as wax. Such electrically insulating medium solid at room temperature and which is liquified on heating may be an electrically insulating organic material melting at 30° C. or higher and preferably at 40° C. or higher. The materials satisfying these requirements may be enumerated by paraffins, waxes and mixtures thereof. The paraffins may be enumerated by 19C to 60C normal paraffins ranging from nonadecane to hexacontane. The waxes may be enumerated by vegetable waxes, such as carnauba wax or cotton wax, animal wax, such as bees wax, ozokerite, and petroleum waxes, such as paraffin wax, microcrystalline wax or petrolatum. These materials are dielectric materials having a dielectric constant of the order of 1.9 to 2.3.

The liquid developer employed in the present invention may be resins, in addition to the coloring agents or electrically insulating media, for imparting anchorage and dispersion stability. Those resins known as resins for the liquid developer may be used without any particular limitations. Examples include rubbers, such as butadiene rubber, styrene-butadiene rubber, cyclized rubber or natural rubber, synthetic resins, such as styrchic resin, vinyl toluene resins, acrylic resins, methacrylic resins, polyester resins, polycarbonate resins or polyvinyl acetate resins, rosin-based resins, hydrogenated rosin-based resins, alkyd resins containing modified alkydes, such as linseed oil modified alkyd resins, and natural resins, such as polyterpenes. In addition, modified phenolic resins, such as phenolic resins or phenol formalin resins, phthalic acid penerithrite, cumarone-indene resins, ester gum resins, vegetable oil polyamide lipids, halogenated hydrocarbon polymers, such as polyvinyl chloride or chlorinated polypropylene, synthetic rubbers, such as vinyl toluene-butadiene or butadiene-isoprene, polymers of acrylic monomers having long-chain alkyl groups, such as 2-ethylhexyl methacrylate, lauryl methacrylate, stearyl methacrylate, lauryl acrylate or octyl acrylate, co-monomers thereof with other copolymerizable monomers, such as styrene-lauryl methacrylate copolymers or acrylic acid-lauryl methacrylate copolymers, polyolefins, such as polyethylene and polyterpenes. The following are among the particularly desirable resins.

For example, an acrylic copolymer soluble in an electrically insulating carrier liquid composed of methyl methacrylate and an acrylic acid ester or a long-chain acrylic ester of methacrylic acid as described in JP-Patent Kokoku JP-B-49-20996, a non-gelated graft polymer having a molecular structure which is composed of a first high molecular chain of a vinyl polymer soluble in an electrically insulating carrier liquid coupled to a second high molecular chain of a vinyl polymer insoluble in the carrier liquid via an urethane linkage and which is insoluble in the carrier liquid, as described in JP Patent Kokai JP-A-58-122557, or a polymer composed of a cross-linked polymer soluble in an electrically insulating carrier liquid, obtained on cross-linking a vinyl polymer having cross-linkable functional groups in the side chain of the molecular structure, and a vinyl copolymer insoluble in the carrier liquid, obtained on copolymerizing a vinyl acetate monomer with a vinyl monomer having an amide group or a basic nitrogen atom in the molecular structure, with the vinyl copolymer insoluble in the carrier liquid being captured by the cross-linked polymer, as described in JP Patent Kokai JP-A-63-208866.

The liquid developer employed in the present invention is a charge controller for charging toner particles. Such charge controller may be of any known compounds exemplified by, for example, metal salts of fatty acids, such as naphthenic acid, octenoic acid, oleic acid, stearic acid, isostearic acid or lauric acid, metal salts of esters of sulfosuccinic acid, metal salts of esters of phosphoric acid, metal salts of aromatic carboxylic acid, and metal salts of aromatic sulfonic acids.

For intensifying charges on the coloring agent, fine particles of metal oxides, such as $SiO_2$, $Al_2O_3$, $TiO_2$, ZnO, $Ga_2O_3$, $In_2O_3$, $GeO_2$, $SnO_2$, $PbO_2$ or MgO, or mixtures thereof, may be added as a charge intensifier.

The step of forming a liquid toner layer is now explained by referring to FIGS. 3 to 11. Three possible embodiments may be conceived for implementing the liquid toner layer forming step in the present invention. One of these possible embodiments may be suitably selected as a function of the type of the developing device employed. in the following explanation, the toner particles are assumed to be charged to a positive polarity. If the toner particles are charged to a negative polarity, it is only necessary to reverse the polarity of the impressed voltage.

Figure 3:
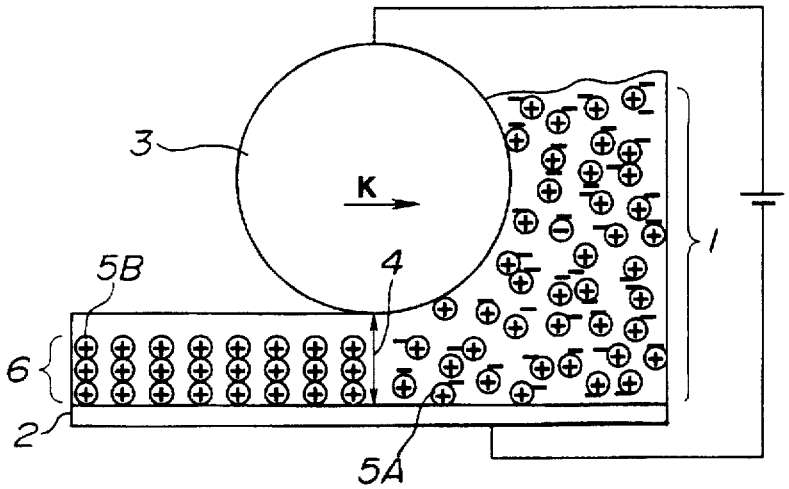
FIGS. 3 and 4 illustrate a first embodiment of a liquid toner layer forming step.
Figure 4:
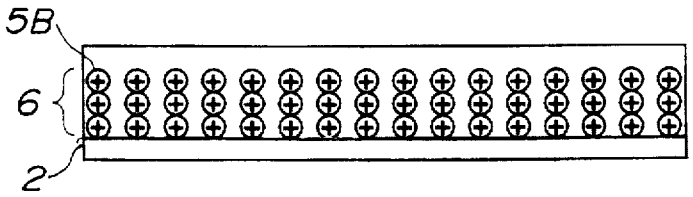

Referring to FIGS. 3 and 4, the first embodiment of the liquid toner layer forming step is explained. In the first embodiment of the liquid toner layer forming step, a developer 1, a developer carrier 2 and a roll 3 for application of an electrical field, are used. The developer carrier 2 is formed as a planar plate of an electrically conductive material, as shown in FIG. 3. The roll 3 for impressing the electrical field is mounted for sliding relative to the developer carrier 2 in proximity to the surface of the developer carrier 2 for forming a gap in-between. The roll 3 is formed of an electrically conductive material and a potential positive with respect to the potential of the developer carrier 2 is impressed across the roll 3.

A large amount of the liquid developer 1 is affixed to the roll 3, as shown in FIG. 3. The roll 3 is then slid relative to the developer carrier 2 in a direction indicated by arrow K in FIG. 3 for removing an excess portion of the liquid developer 1 for forming a liquid developer layer 4 between it and the developer carrier 2. The liquid developer layer 4 has a thickness substantially equal to the distance between the roll 3 and the developer carrier 2. At the same time as the roll 3 forms the liquid developer layer 4, it generates the phenomenon of electrophoresis in the charged toner particles 5A in the liquid developer layer 4 depending on the difference in electrical potential between it and the developer carrier 2. The charged toner particles 5A in the liquid developer layer 4 are attracted to the developer carrier 2 lower in electrical potential than the roll 3, while being charged to the positive polarity by the roll 3 and the developer carrier 2. By migration of the charged toner particles 5B towards the developer carrier 2, a liquid toner layer 6, in which the charged toner particles are assembled together, is formed, as shown in FIG. 4.

Figure 5:
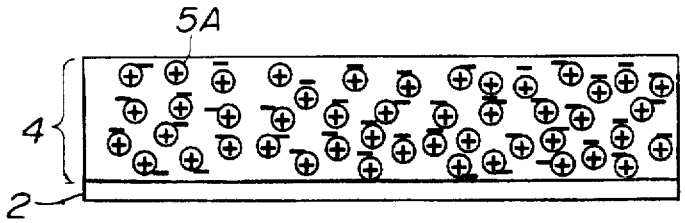
FIGS. 5 to 7 illustrate a second embodiment of a liquid toner layer forming step.
Figure 6:
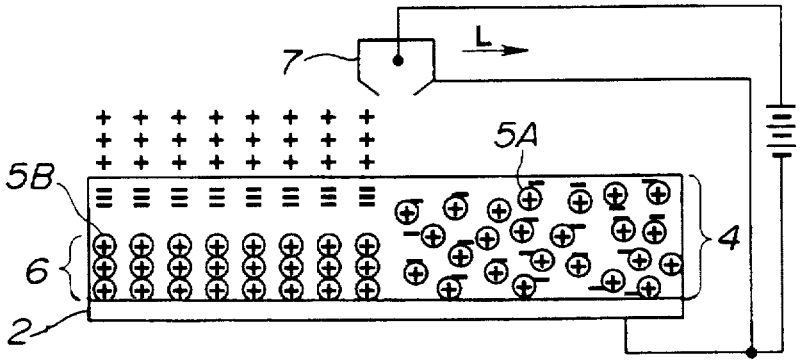
Figure 7:
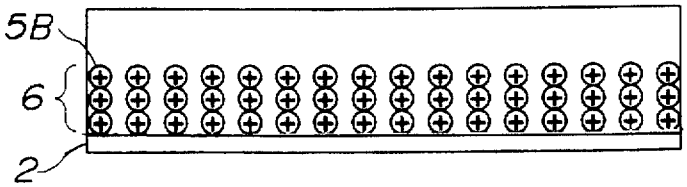

Referring to FIGS. 5 to 7, the second embodiment of the liquid toner layer forming step is explained. In the second embodiment of the liquid toner layer forming step, the liquid developer 1, the developer carrier 2 and a corona charger 7 are employed. The developer carrier 2 is formed as a planar plate of an electrically conductive material and the liquid developer layer 4 is formed on its surface to a pre-set thickness, as shown in FIG. 5. The corona charger 7 is mounted in proximity to the surface of the liquid developer layer 4 formed on the developer carrier 2 for sliding relative to the developer carrier 2, as shown in FIG. 6.

First, the corona charger 7 charges the surface of the liquid developer layer 4 uniformly to, for example, the positive polarity, as shown in FIG. 6. The corona charger 7 then is slid relative to the developer carrier 2 in a direction shown by arrow L in FIG. 6 for uniformly charging the entire surface of the liquid developer layer 4 formed on the developer carrier 2 to the positive polarity. By such charging by the corona charger 7, the charged toner particles 5A in the liquid developer layer 4 are charged to the positive polarity. By movement of all of the charged toner particles 5B towards the developer carrier 2, there may be formed the liquid toner layer 6 formed by the charged toner particles assembled together, as shown in FIG. 7.

Figure 8:
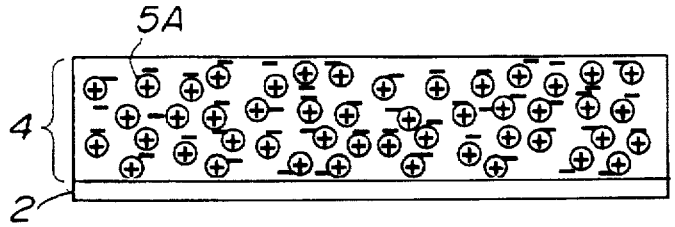
FIGS. 8 to 10 illustrate a third embodiment of a liquid toner layer forming step.
Figure 9:
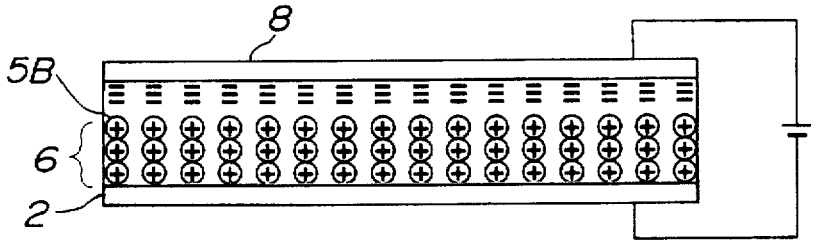
Figure 10:
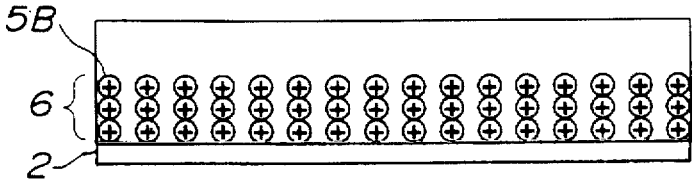

Referring to FIGS. 8 to 10, the third embodiment of the liquid toner layer forming step is explained. In the third embodiment of the liquid toner layer forming step, the liquid developer 1, the developer carrier 2 and an electrical field impressing electrode plate 8 are used. The developer carrier 2 is formed as a planar plate of an electrically conductive material and the liquid developer layer 4 is formed on its surface to a pre-set thickness, as shown in FIG. 8. The electrode plate 8 is mounted in proximity to the surface of the developer carrier 2 for defining a developing electrical field, as shown in FIG. 9. The electrode plate 8 is formed of an electrically conductive material and a positive potential relative to the potential of the developer carrier 2 is impressed across the electrode plate 8.

The electrode plate 8 is contacted with the surface of the liquid developer layer 4 on the developer carrier 2, as shown in FIG. 9. The electrode plate 8 produces the phenomenon of electrophoresis in the charged toner particles 5A in the liquid developer layer 4 depending on the potential difference between it and the developer carrier 2. The charged toner particles 5A in the liquid developer layer 4 are attracted to the developer carrier 2 lower in electrical potential than the roll 3, while being charged to the positive polarity by the electrode plate 8 and the developer carrier 2. By movement of the charged toner particles 5B towards the developer carrier 2, a liquid toner layer 6, in which the charged toner particles are assembled together, is formed, as shown in FIG. 10.

Figure 11:
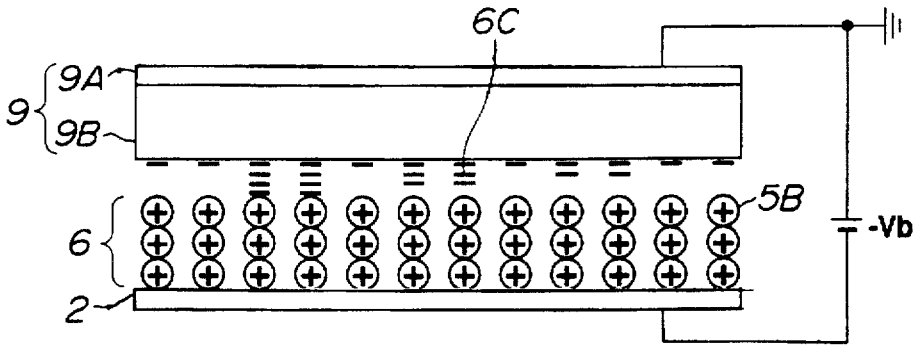
FIGS. 11 and 12 illustrate the state of a developer image formed on the developer carrier by the developing step.
Figure 12:
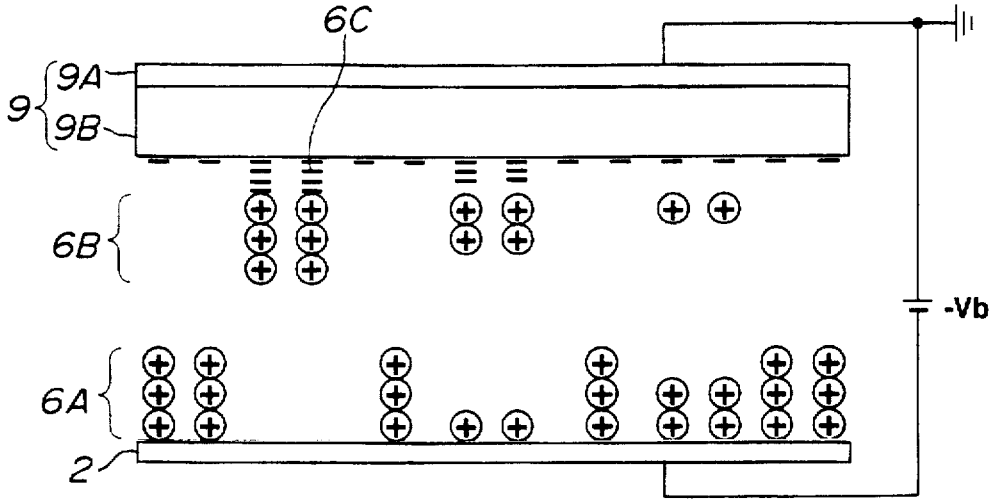

The development step of the present invention is now explained by referring to FIGS. 11 and 12. In the following explanation, toner particles are assumed to be charged to the positive polarity.

in the developing step, the developer carrier 2 and the charge carrier 9 are used, as shown in FIGS. 11 and 12. The charge carrier 9 is comprised of an electrically conductive substrate 9A on the surface of which a photosensitive layer 9B formed of an organic or inorganic photoconductive material is formed, as shown in FIG. 11. On the surface of the electrically conductive substrate 9A is formed an electrostatic latent image 6C corresponding to image data. The electrostatic latent image means an electrostatically formed image or letter. In a laser printer, for example, a uniform electrostatic latent image is previously formed on the photosensitive layer by a corona charger and a laser beam is radiated on the surface of the photosensitive layer for removing unneeded charges for forming the electrostatic latent image corresponding to the image data.

The developer carrier 2 is formed as a planar plate of an electrically conductive material and the liquid toner layer 6 is formed on its surface to a pre-set thickness. A negative voltage −Vb is impressed across the developer carrier 2 relative to the electrically conductive substrate 9A. The charge carrier 9 is contacted in this state on the surface of the liquid toner layer 6 on the developer carrier 2.

The developer carrier 2 is formed as a planar plate of an electrically conductive material and the liquid developer layer 6 is formed on its surface to a pre-set thickness. A negative voltage −Vb is impressed across the developer carrier 2 with respect to the electrically conductive substrate 9A of the charge carrier 9. The charge carrier 9 is contacted in this state on the surface of the liquid toner layer 6 on the developer carrier 2.

It is the potential of the electrostatic latent image 6C formed on the charge carrier 9 that determines whether the liquid toner layer 6 is to be left undeveloped on the developer carrier 2 or to be transcribed onto the charge carrier 9.

Figure 13:
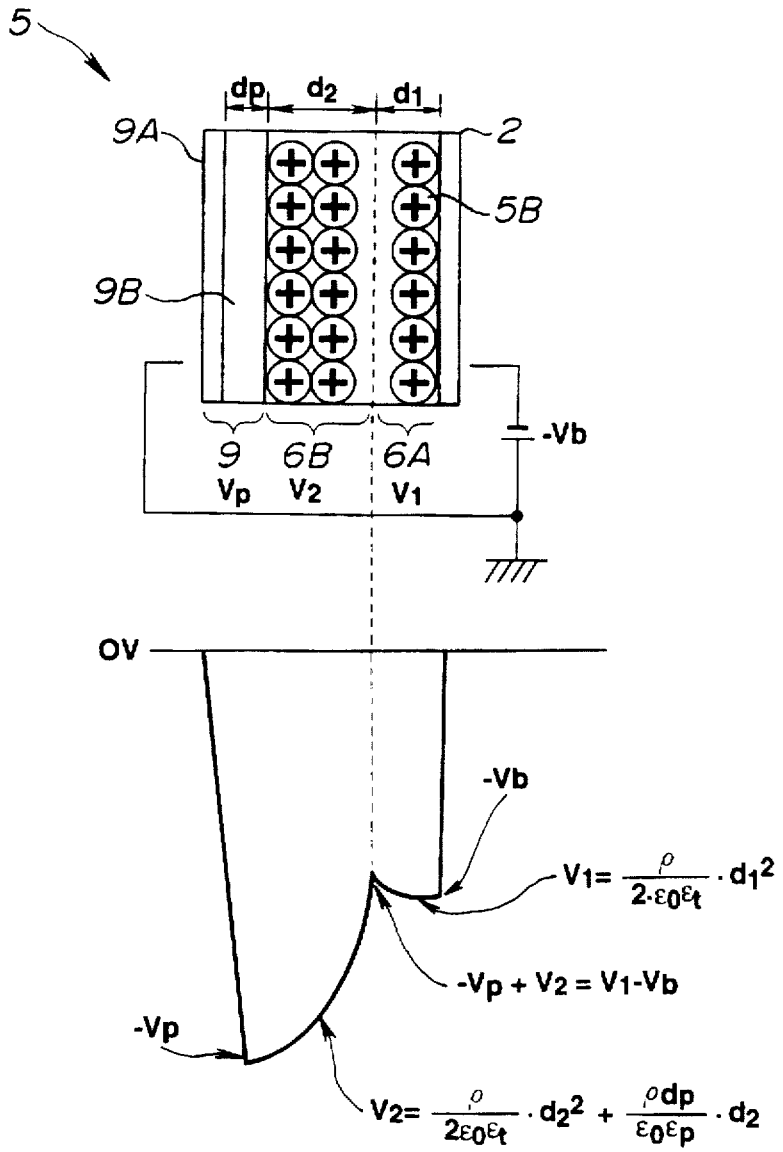
FIG. 13 illustrates the state of an equilibrium potential separation phenomenon in the developing step.

Referring to FIG. 13, the state how the phenomenon of equilibrium potential separation occurs is explained. The phenomenon of equilibrium potential separation is such a phenomenon in which the liquid toner is separated to a toner portion on the developer carrier 2 and to a toner portion on the charge carrier 9. if, at the time point when development comes to a close, the thickness of the liquid toner layer 6 remaining on the developer carrier 2 is d1 and the thickness of the liquid toner layer 6B deposited to the charge carrier 9 is d2, the thickness dt of the liquid toner layer 6 formed on the developer carrier 2 prior to development is given by the equation (1):

$$dt=d1+d2 \tag{1}$$

On the other hand, the potential V1 of the liquid toner layer 6A along the thickness from the developer carrier 2 is given by the equation (2):

$$V1=\rho(d_1)^2/2\epsilon_0\epsilon_t \tag{2}$$

where ρ is the current density of the liquid toner layer 6B, εt is the specific dielectric constant of the liquid toner layer 6B and d1 is the thickness of the liquid toner layer 6B affixed to the developer carrier 2.

The toner potential V2 of the liquid toner layer 6B in the direction of thickness from the charge carrier 9 is given by the equation (3):

$$V2=\rho(d_2)^2/2\epsilon_0\epsilon_t+\rho(d_p)(d_2)/\epsilon_0\epsilon_t \tag{3}$$

where ρ is the charge density of the liquid toner layer 6B, ε0 is the dielectric constant of vacuum, εt is the specific dielectric constant of the liquid toner layer 6b, εp is the specific dielectric constant of the charge carrier 9, d2 is the thickness f the liquid toner layer 6B deposited on the charge carrier 9 and dp is the thickness of the photosensitive layer 9B of the charge carrier 9.

If the voltage applied across the developer carrier 2 is −Vb and the potential of the electrostatic latent image formed on the surface of the charge carrier is −Vp, the sum of the potential across the developer carrier 2 and the potential across the liquid toner layer 6A deposited thereon subsequent to development is (V1−Vb), while the sum of the potential across the charge carrier 9 and the potential across the liquid toner layer 6A deposited thereon after development is (−Vp+V2).

If the liquid toner layer 6 is separated after development to a toner layer portion on the developer carrier 2 and to a toner layer portion on the charge carrier 9, there exist such toner potential V1 and such toner potential V2 for which the sum potential (V1−Vb) of the developer carrier 2 and the liquid toner layer 6A affixed to the developer carrier 2 after development becomes equal to the sum potential (−Vp+V2) of the charge carrier 9 and the liquid toner layer 6B as shown by the equation (4):

$$-Vp+V2=V1-Vb \tag{4}$$

In the vicinity of a point where the equation (4) holds, the liquid toner is attracted towards the developer carrier 2 and towards the charge carrier 9 if the toner is located closer to the developer carrier 2 or towards the charge carrier 9, respectively. Thus the liquid toner layer 6 is separated into a liquid toner layer 6A towards the developer carrier 2 and a liquid toner layer 6B towards the charge carrier 9, with the point represented by the equation (4) as a boundary. The state of separation of the liquid toner layer 6 may be found by solving the equations (1), (2) and (3) for d2, as shown by the equation (5):

$$d2=\{1/(dt/\epsilon_t+dp/\epsilon_p)\}\{(Vp-Vb)\epsilon 0/\epsilon_0\rho+(dt)^2/2\epsilon_t \quad \}(5)$$

Substituting the value of d2 thus found into the equation (1) and finding d1, the following equation (3') is obtained:

$$d1=dt-d2 \tag{3'}$$

That is, if there exist V1 and V2 for which the equation (4) holds, d1 and d2 are uniquely defined, and the respective values are found by the equation (3'). On the other hand, if the developing method employing the liquid developer is executed so that the equation (4) is satisfied, the thickness d2 of the liquid toner layer 6B affixed to the charge carrier 9 may be continuously changed by continuously changing the potential −Vp of the electrostatic latent image formed on the surface of the charge carrier 9, as will become apparent from the equation (5).

Therefore, the image gradation can be represented by forming an electrostatic latent image in which the surface potential of the charge carrier 9 is changed insofar as the equation (4) is met. Thus the developing method of the present invention may be applied to representation of the gradation in a printer or the like.

Figure 14:
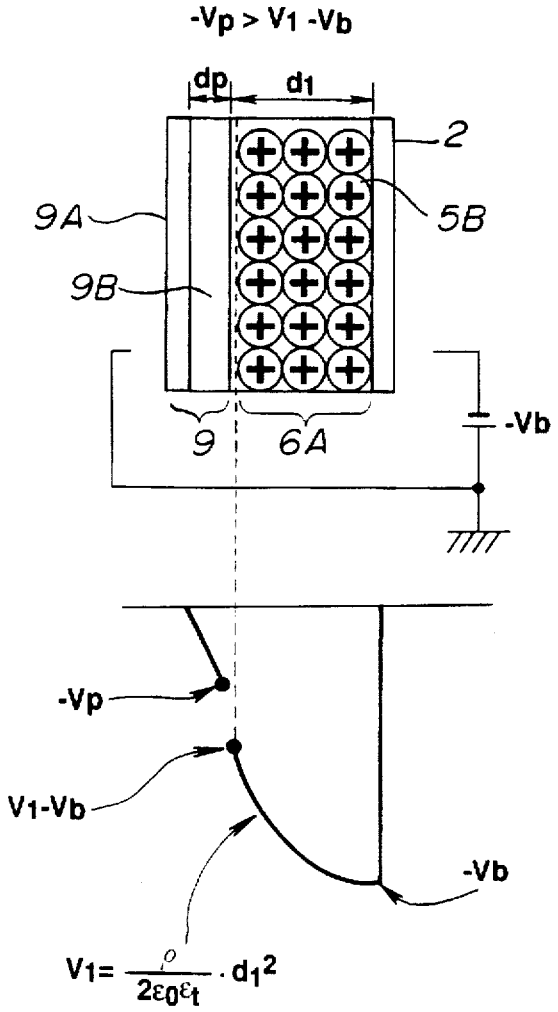
FIG. 14 illustrates the state in which the liquid toner layer is left in its entirety on the developer carrier in the developing step.
Figure 15:
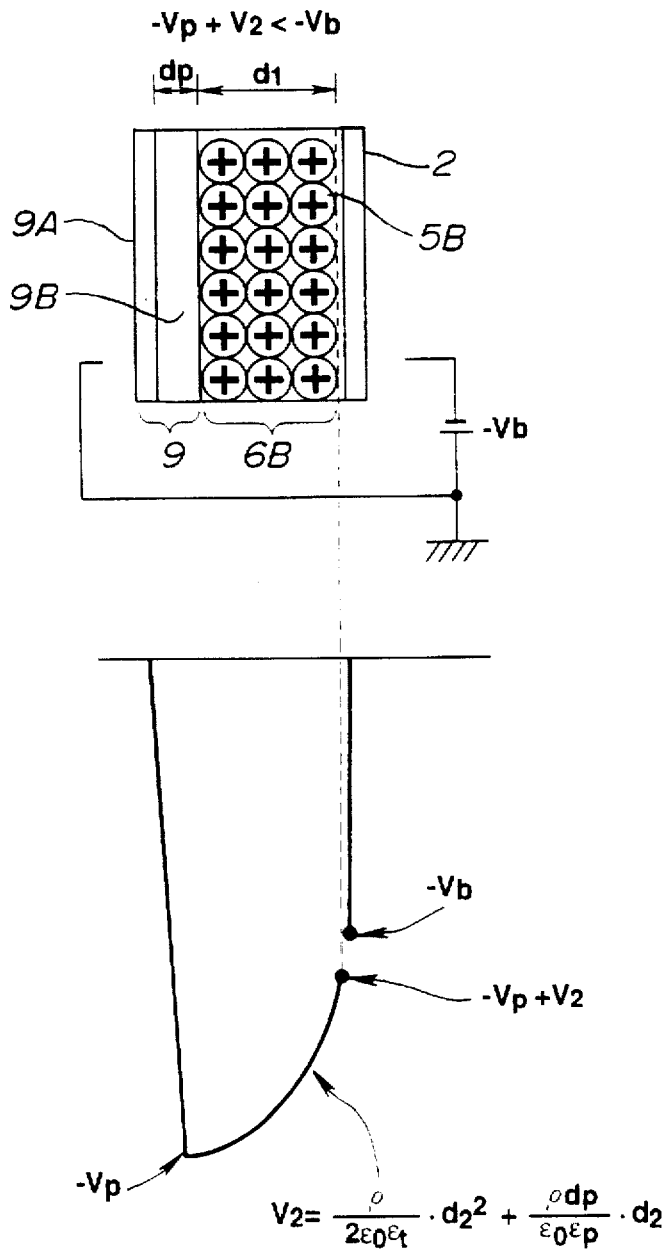
FIG. 15 illustrates the state in which the liquid toner layer is left in its entirety on the charge carrier in the developing step.

Referring to FIGS. 14 and 15, such case is explained in which the liquid toner layer 6 is left or affixed on only one of the developer carrier 2 or the charge carrier 9. In such case, the equation (V1−Vb) is not equal to −Vp+V2, as shown in FIGS. 14 and 15.

It is first assumed that the liquid toner layer 6 charged to the positive terminal is left in its entirety on the developer carrier 2, as shown in FIG. 14. If the value of V1 is V1(t), the state of the potential is given by the equation (6):

$$-Vp>V1(t)-Vb \ (V2=0) \tag{6}$$

The equation (6) means that the potential {V1(t)−Vb} on the developer carrier 2 is lower than the potential −Vp of the electrostatic latent image formed on the surface of the charge carrier 9. Thus the liquid toner layer 6, charged to the positive polarity, remains attracted in its entirety by the developer carrier 2. The result is that the thickness of the liquid toner layer 6B affixed to the charge carrier 9 becomes equal to zero. That is, in the case of the equation (4), the equations d1=dt and d2=0 necessarily hold.

Therefore, if the developing method employing the liquid developer is executed by a monochromatic printer, that is a bi-level printer, the liquid toner layer may be left in its entirety on the developer carrier 2 with a margin under the condition of the equation (6). In this case, the condition for producing a white area is met.

It is then assumed that the liquid toner layer 6 charged to the positive polarity is affixed in its entirety on the charge carrier 9, as shown in FIG. 15. If the value of V2 at this time is V2(t), the potential state in this case is given by the equation (7):

$$-Vp+V2(t)<-Vb(V1=0) \quad (7)$$

This equation means that, if the liquid toner layer 6 charged to the positive polarity is affixed in its entirety to the charge carrier 9, the potential of the charge carrier 9 [−Vp+V2(t)] is still lower than the potential −Vb of the developer carrier 2, such that the liquid toner layer 6, charged to the positive polarity, in its entirety remains attracted to the charge carrier 9. The thickness of the liquid toner layer 6A left on the developer carrier 2 becomes equal to zero. That is, in the case of the equation (4), the equations d1=0 and d2=dt necessarily hold.

Therefore, if the developing method employing the liquid developer is executed by a bi-level printer, the liquid toner layer 6 may be left in its entirety on the charge carrier 9 with a margin under the condition of the equation (6). In this case, the condition for producing a black area is met.

The charge carrier 9 is not limited to such a charge carrier comprised of the photosensitive layer 9B formed n the surface of the electrically conductive substrate 9A, but may also be such a carrier in which an electrostatic latent image is formed on the surface of a dielectric material by, for example, a charge needle.

An experimental example for verification of such principle is hereinafter explained. The method for producing a liquid developer employed in this experimental example is first explained.

First, a resin employed for the liquid developer was prepared. Specifically, 93.8% by weight of ACRESTER L manufactured by MITSUBISHI RAYON SHA, 3.7% by weight of ACRYESTER HP manufactured by MITSUBISHI RAYON SHA, 3.0% by weight of ACRYESTER PA manufactured by MITSUBISHI RAYON SHA, 2.5% by weight of PERBUTYL O, a polymerization catalyst manufactured by NIPPON YUSHI SHA, 1.5% by weight of PERBUTYL Z, a polymerization catalyst manufactured by NIPPON YUSHI SHA, and 100% by weight of ISOPAR G, an aliphatic hydrocarbonic solvent manufactured by EXXON CHEMICALS INC. were charged into a reaction vessel fitted with a nitrogen gas inlet pipe, a stirrer and a cooling tube, and reacted at 108° C. for eight hours to produce a polymer containing 48.8% by weight of a non-volatile component.

The temperature was then lowered to 70° C. and 5.7% by weight of isophorone diisocyanate, 0.05part by weight of dibutyltin dilaurate and 5.7% by weight of ISOPAR G, an aliphatic hydrocarbonic solvent manufactured by EXXON CHEMICALS INC. were added to the reaction system. After a urethane reaction was conducted at 70° C. for four hours, the reaction product was cooled to give a solution of an intermediate product containing 48.6% by weight of a non-volatile matter.

80% by weight of the solution of the intermediate product were charged into a reaction vessel similar to one described above, and 105% by weight of ISOPAR G, an aliphatic hydrocarbon solvent manufactured by EXXON CHEMICALS INC., 2.7% by weight of ACRYESTER HP manufactured by MITSUBISHI RAYON SHA, 28.6% by weight of ACRYESTER EH manufactured by MITSUBISHI RAYON SHA, 28.7 pats by weight of methyl methacrylate manufactured by MITSUBISHI GAS KAGAKU SHA, 0.3 part by weight of PERBUTYL Z, a polymerization catalyst manufactured by NIPPON YUSH SHA and 5.0% by weight of ISOPAR G, an aliphatic hydrocarbon solvent manufactured by EXXON CHEMICALS INC. were added into the reaction vessel. After cooling, a solution of a graft polymer containing 28.5% by weight of non-volatile components was produced. The liquid dispersion of a fixer thus obtained was termed "resin A".

A coloring agent was then prepared by using the following composition:

| | |
|---|---|
| carbon black (ELFTEX 8 manufactured by CABOT INC.) | 15% by weight |
| SPIRIT BLACK SB (manufactured by ORIENT CHEMICALS INC.) | 0.6 part by weight |
| OIL BLACK BW (manufactured by ORIENT CHEMICALS INC.) | 5% by weight |
| EPICOAT 1004 (manufactured by SHELL PETROLEUM INC.) | 50% by weight |
| EPICOAT 1007 (manufactured by SHELL PETROLEUM INC.) | 25% by weight |

A mixture having the above composition was melt-kneaded using a pressure kneader to produce a colored kneaded mass which was then crushed using a rotoplex to produce fine particles of the coloring agent having a mesh size of 1 mm.

The resin A and the coloring agent, thus obtained, were used in the composition of

| | |
|---|---|
| coloring agent | 60% by weight |
| resin A | 20% by weight |
| zirconium naphthenate (manufactured by Dainippon Ink Chemicals, Incorporated containing 40% by weight of a non-volatile component) | 1.8% by weight |
| Isopar G (aliphatic hydrocarbon solvent manufactured by EXXON CHEMICALS INC.) | 150% by weight |

for preparing a concentrated liquid toner.

The above mixture was uniformly mixed and kneaded in a ball mill. The resulting liquid dispersion was diluted with ISOPAR G (an aliphatic hydrocarbon solvent manufactured by EXXON CHEMICALS INC.) so that the non-volatile component accountED for 5 wt %. The toner particles contained in the liquid developer were charged to a positive polarity.

The method for measuring the current density ρ is hereinafter explained.

A pair of metal electrodes, each measuring 25 $cm^2$ in area, were placed with a gap distance of 2 mm, in which the liquid developer 1 was charged. An electrical potential of 1 kV was applied across the metal electrodes and the resulting assembly was allowed to stand for 30 seconds. The current that flowed across the electrodes was integrated with respect to time to find the total amount of charges Q present across the electrodes. If the volume of the gap defined by the metal electrodes is V, the current density ρ may be found by:

$$\rho=Q/V.$$

Figure 16:
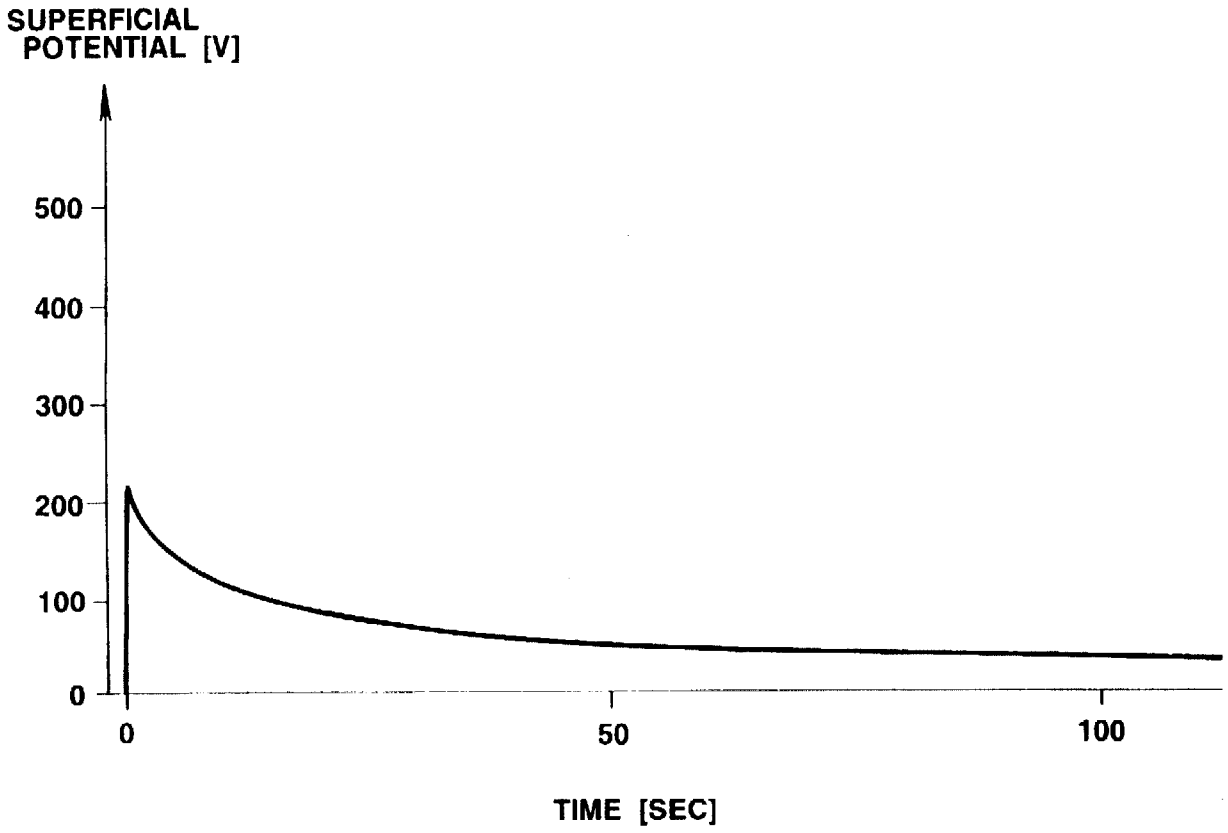
FIG. 16 is a graph for illustrating the potential of the toner particle surface.

The liquid toner layer 6 was then formed. Specifically, the liquid developing agent 1 was charged in a space between the electrodes having a gap of 50 m and a voltage of 500 V was applied across the electrodes. The charged toner particles migrate under electrophoresis towards the negative electrode to form the liquid toner layer 6 formed by the charged toner particles assembled together. The surface potential of the charged toner layer was approximately 200V. While the surface potential of the liquid toner layer 6 was attenuated with time as shown in FIG. 16, the time constant τ until the potential reaches a value of 1/e of the peak value is approximately 23 seconds.

The charge carrier was then applied under pressure against the liquid toner layer 6 formed between the metal electrodes for development. A polyethylene terephthalate (PET) film, 50 m in thickness, having a transparent electrode deposited thereon by vacuum deposition, was used as the charge carrier 9 in lace of an organic photoconductor (OPC). In several seconds after formation of the liquid toner layer 6, the above PET, charged to an optimum potential, was applied under pressure to the liquid toner layer 6 for development. Meanwhile, a bias voltage of −60 V is applied across the metal electrodes supporting the liquid toner layer 6 after formation of the liquid toner layer 6.

Figure 17:
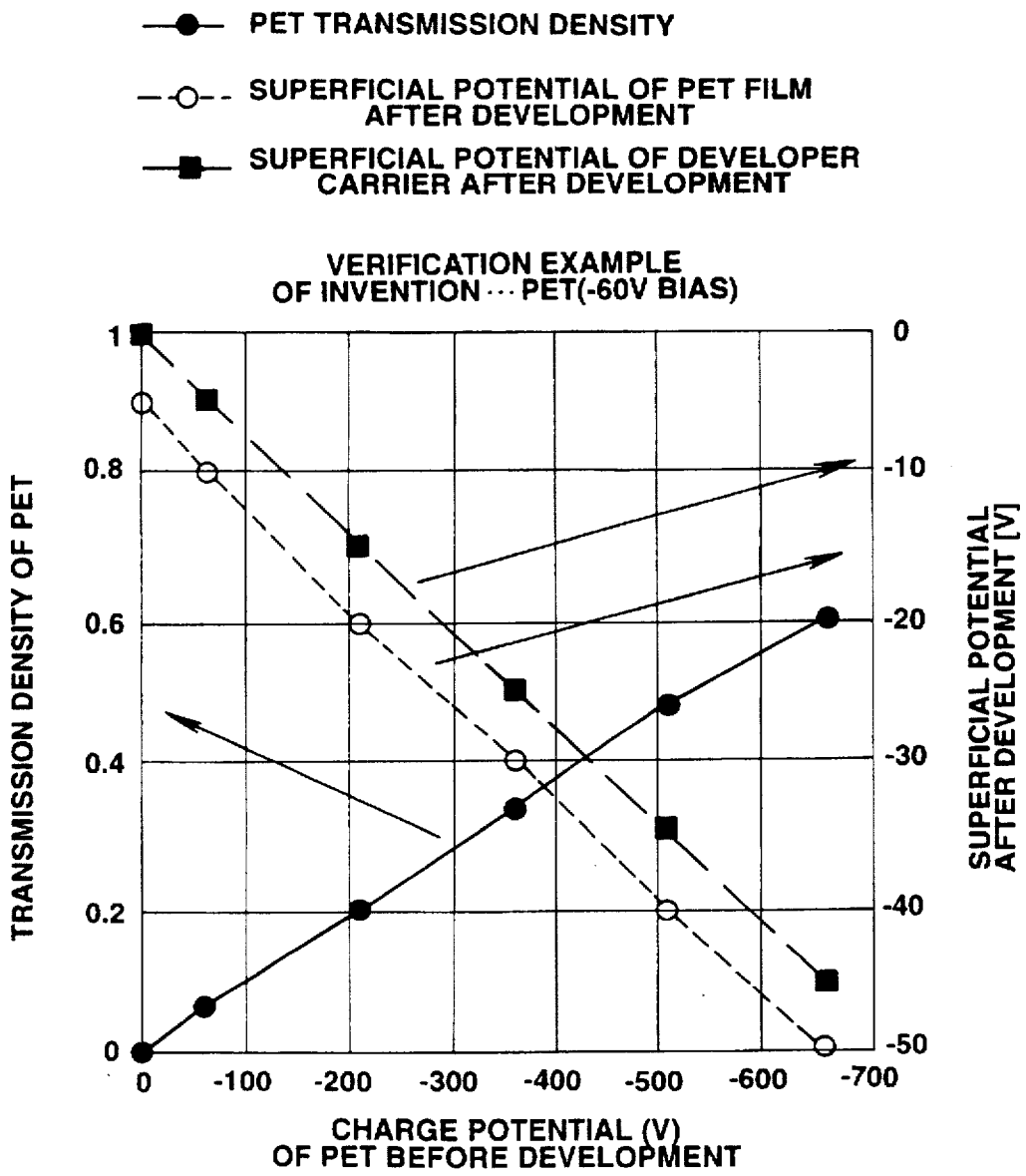
FIG. 17 is a graph for illustrating the transmission density of a PET film obtained after development, surface potential of the liquid toner layer deposited on the PET film and the surface potential of the liquid toner layer left on the developer carrier.

FIG. 17 shows the relation between the charging potential of a PET film on one hand and the transmission density of the liquid toner layer 6B developed on the PET film, the surface potential (−Vp+V2) of the liquid toner layer 6B developed on the PET film and the surface potential (V1−Vb) of the liquid toner layer left on the developer carrier.

It is seen that the surface potential (−Vp+V2) of the liquid toner layer 6B developed on the as-developed PET film and the surface potential (V1−V2b) of the liquid toner layer 6A left on the developer carrier are increased substantially equally with increase in the negative direction of the charge potential of the PET film. It is also seen that the thickness of the liquid toner layer 6B developed on the PET film is increased with increase in the negative direction of the charge potential (−Vp) of the PET film. The results of the present experiment indicate that the equations (4) and (5) hold.

Although the positive development method for developing the electrostatic latent image with charged toner particles of the opposite polarity to that of the latent image is described hereinabove, it is of course possible to envisage the reverse method of developing non-charged areas of an image using toner particles charged to the opposite polarity to that of the charge carrier.

In the foregoing, description has been made of developing the positively charged toner particles on a negatively charged carrier using the equations (4), (6) and (7). These equations are represented by the following equations, in which the letters can take positive and negative values:

$$Vp+V2=V1+Vb \quad (4')$$

$$Vp>V1(t)+Vb \ (V2=0) \quad (6')$$

$$Vp+V2(t)<Vb \ (V1=0) \quad (7')$$

These equations (4'), (6') and (7') can represent developing conditions not only for the positive developing method of developing an image using toner particles charged to the opposite polarity to that of the electrostatic latent image but also for the reverse process of developing a non-charged image area with toner particles charged to the same polarity as that of the charge carrier.

That is, the equation (4') is a general formula representing the condition for the phenomenon of equilibrium potential separation to take place, while the equation (6') is a general formula representing the condition under which the liquid toner layer is left in its entirety on the developer carrier 8 and the equation (7') is a general formula representing the condition under which the liquid toner layer is affixed in its entirety on the charge carrier 15.

Figure 18:
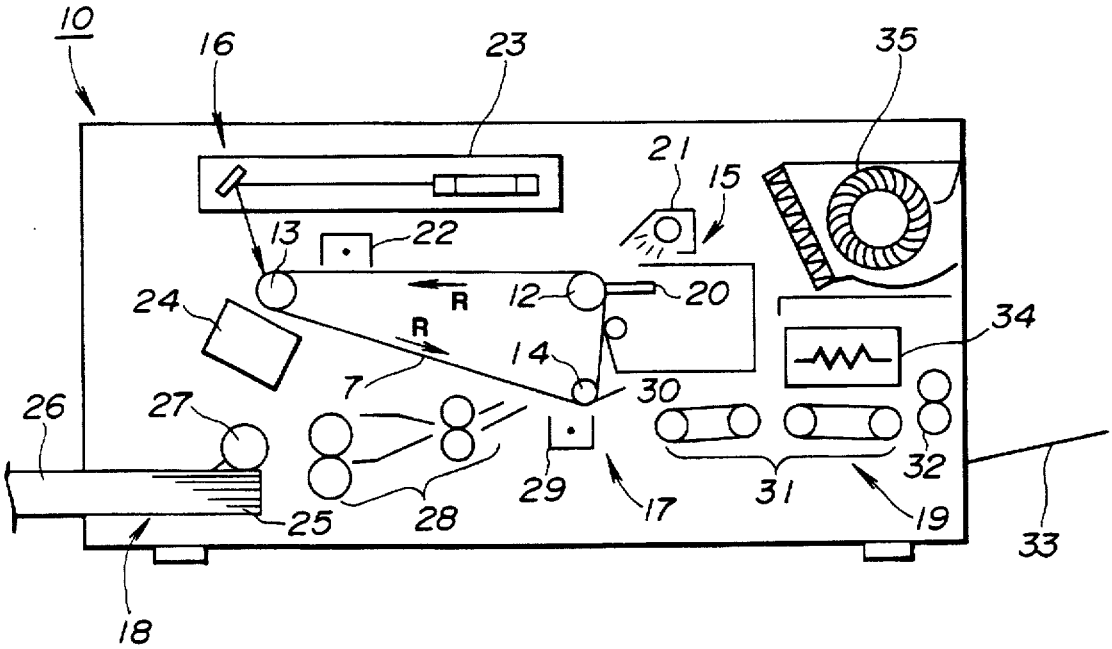
FIG. 18 illustrates a laser printer having a photosensitive belt.
Figure 19:
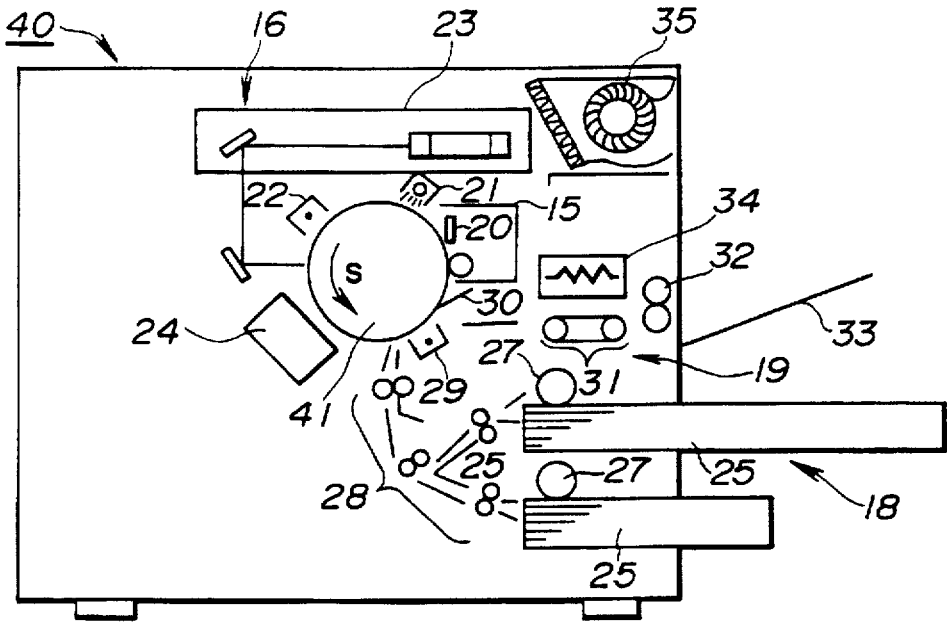
FIG. 19 illustrates a laser printer having a photosensitive drum.

In the foregoing, description has been made of the principle and an experimental example of a development method of the present invention using a liquid developer and a developer carrier in the form of a planar plate. Referring to FIGS. 18 and 19, explanation will be made of preferred embodiments of the present invention applied to a laser printer having a photosensitive belt and to a laser printer having a photosensitive drum.

Referring to FIG. 18, the laser printer 10 having the photosensitive belt is made up of an endless photosensitive belt 11 placed over plural rolls 12 to 14, a cleaning unit 15, an image-forming processor 16 and a transcription exfoliation unit 17, placed sequentially on a running path of the photosensitive belt 11, a recording sheet supply unit 18 for supplying a recording sheet 25 to the transcription exfoliation unit 17 and a discharging unit 19 for discharging the recording sheet 25 exfoliated from the photosensitive belt 11.

The photosensitive belt 11 is comprised of a flexible electrically conductive substrate on the surface of which is formed a photosensitive layer of an organic or inorganic photoconductive material. The leading and trailing ends of the belt are connected together to form an endless belt. The photosensitive belt 11 is run by plural rolls 12 to 14 inclusive of the driving roll 13. The photosensitive belt 11 is placed on the rolls 12 to 14 to form a running path of a substantially rectangular triangle and is run in a direction indicated by arrow R in FIG. 18.

The cleaning unit 15 is mounted on the outer periphery of the first roll 12 upstream of the image-forming processor 16 along the travel path of the photosensitive belt 11 as explained previously. The cleaning unit 15 is made up of a blade 20 for removing the liquid developer affixed to the surface of the photosensitive belt 11 and a de-electrifying lamp 21 for de-electrifying the surface of the photosensitive belt 11 charged in the image forming process.

The distal end of the blade 20 is abutted against the photosensitive belt 11 for removing the liquid developer left on the surface of the belt 11. The de-electrifying lamp 21 is lit for de-electrifying residual positive charges.

The photosensitive belt 11, the surface of which thus has been cleaned, is run to the image-forming processor 16 where an image is formed on the belt surface. The image-forming processor 16 is made up of a first charger 22, a laser exposure unit 23 constituting light exposure means and a developer 24.

The first charger 22 is a corona charger mounted in proximity to the surface of the photosensitive belt 11 for forming e.g., uniform negative charges on the surface of the photosensitive belt 11.

The laser light exposure unit 23 is actuated responsive to imaging signals sent from a controller, not shown, for selectively lighting the surface of the photosensitive belt 11 with a laser beam via an optical system. The photosensitive belt 11, thus irradiated with the laser light beam, is freed of negative charges formed on the exposed surface portions for forming an electrostatic latent image corresponding to the image signals.

After the electrostatic latent image is formed on the photosensitive belt 11 in the laser exposure unit 23, the photosensitive belt 11 is run to the developing unit 24 for developing the latent image. Thus the developing unit 24 supplies the liquid developing agent to the surface of the photosensitive belt 11 for forming a developer image from the latent image. The photosensitive belt 11 is further run and folded back by the second roll 14. In this folded-back portion, the recording sheet 25 is supplied from the recording sheet supplying unit 18.

The recording sheet supplying unit 18 is comprised of a sheet supplying unit 27, not shown in detail, for feeding out the recording sheets 25 housed within the sheet feeder cassette 26, one by one, and a guide roll unit 28 for transferring the recording sheet 25 thus fed out.

The recording sheet 25 is fed under minor pressure onto the surface of the photosensitive belt 11 folded by the second roll 14.

The photosensitive belt 11 is run along a running path defined between the drive roll 13 and the second roll 14 with the recording sheet 25 tightly contacted with the belt surface. Consequently, the developer image formed on the surface of the photosensitive belt 11 is transcribed onto the recording sheet 25.

On a running route of the photosensitive belt 11, along which the belt 11 runs with the recording sheet 25 superimposed thereon, there is provided the transcription exfoliation unit 17 made up of a second charger 29, second roll 14 and an exfoliation pawl 30.

When run as far as the second roll 14, the photosensitive belt 11 is folded back towards the first roll 12. This exfoliates the recording sheet 25 from the photosensitive belt 11. The exfoliated sheet 25 is discharged along the exfoliation pawl 30 towards the discharging unit 19.

The discharging unit 19 includes plural transporting belts 31 for transporting the recording sheet 25, plural sheet discharging rolls 32, a fixer 34 for fixing the developer image on the transported recording sheet 25, and a discharging pan 33 for receiving the recording sheet 25 on which has been fixed the developer image. The fixer 34 is comprised of, for example, an electric heater for thermally fixing the developer image by the liquid developer transcribed on the recording sheet 25 for fixing the image on the recording sheet 25.

The photosensitive belt 11 is folded back by the second roll 14 towards the first roll 12 where the recording sheet 25 is exfoliated from the belt 11 which is run towards the cleaning unit 15. The photosensitive belt 11 is de-electrified and cleaned by the cleaning unit 11 and again run towards the image-forming processor 16 for forming the next image. The laser printer 10, fitted with the photosensitive belt 11, is provided with an exhaust fan 35.

A laser printer 40, having the photosensitive drum, has the basic structure similar to the structure of the laser printer having the photosensitive belt, as shown in FIG. 19. The laser printer 40 has the characteristics that it has a photosensitive drum 41 in place of the photosensitive belt 11 and rolls for driving the photosensitive belt 11. In the following description, the parts and components similar to those of the laser printer 10 having the photosensitive belt are denoted by the same reference numerals and the corresponding description is omitted for simplicity.

Referring to FIG. 19, the laser printer 40 is made up of the photosensitive drum 41, around which the cleaning unit 15, image-forming processor 16 and the transcription exfoliation unit 17 are sequentially arrayed, a recording sheet supplying unit 18 for supplying the recording sheet 25 to the transcription exfoliation unit 17 and a discharging unit 19 for discharging the recording sheet 25 exfoliated from the photosensitive drum 41. The photosensitive drum 41 is comprised of an electrically conductive substrate on the surface of which is formed a photosensitive layer formed of an organic or inorganic photoconductive material. The photosensitive drum 41 is run in rotation in a direction indicated by arrow S in FIG. 19 by driving means, not shown.

In the laser printer 10 having the photosensitive belt or the laser printer 40 having the photosensitive drum, the above-described developing unit 24 is used. In the developing unit 24, the developing method, employing the liquid developer, of the present invention is used. In the following description of the developing method employing the liquid developer, it is assumed that the toner particles are charged to the positive polarity. If the toner particles are charged to the negative polarity, the following description holds provided that the impressed voltage is reversed in polarity.

Figure 20:
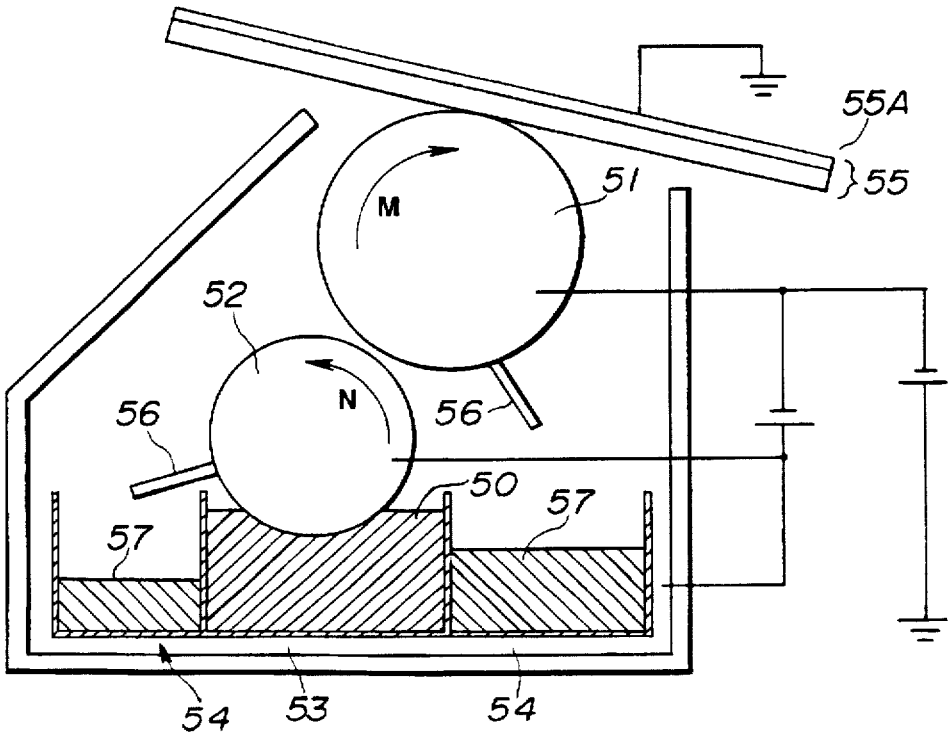
FIG. 20 illustrates a first embodiment of the development method employing a liquid developer.

Referring to FIG. 20, the first embodiment of the developing method employing the liquid developer is explained. In the first embodiment of the liquid developing method employing the liquid developer, a liquid developer 50, a developing roll 51, an electrical field impressing roll 52, a developer vessel 53, and a recovery vessel 45 are used, as shown in FIG. 20.

The developing roll 51 is run in rotation at a rotational speed equal to the speed of movement of a photosensitive member 55 having its photosensitive substrate 55A grounded, as indicated by arrow M in FIG. 20. A developing bias voltage is impressed across the developing roll 51 formed of metal. A scraper 56 of an elastic material is applied against the developing roll 51 for removing the liquid developer 57 left on the surface of the developing roll 51.

In addition to being formed only of metal, the developing roll 51 may be formed of metal and an electrically conductive elastic layer and an electrically conductive surface layer may be formed on the metal part of the roll 51. This structure is suited in particular if the photosensitive member 55 is the photosensitive drum 55.

The electrical field impressing roll 52 is run in rotation in a direction indicated by arrow N in FIG. 20 and is mounted in proximity to the surface of the developing roll 51 with a suitable gap in-between. A potential which is positive with resect to the potential of the developing roll 51 is impressed across the electrical field impressing roll 52 formed of metal. The scraper 56 of an elastic material is applied against the electrical field impressing roll 52 for removing the liquid developing agent 57 left on the surface of the electrical field impressing roll 52. The electrical field impressing roll 52 may also be run in rotation in the direction opposite to the direction indicated by arrow N in FIG. 20.

In the developer vessel 53 is contained the unused liquid developer 50. The developer vessel 53 is arranged so that part of the peripheral surface of the electrical field impressing roll 52 is dipped in the liquid developer 50. The electrical potential substantially equal to that of the electrical field impressing roll 52 is applied across the developer vessel 53 formed of metal.

The recovery vessel 54 is formed of metal and mounted as one with the developer vessel 53. The recovery vessel 54 is mounted for recovering the liquid developer 50 left on the surface of the developer roll 51 removed by the scraper 56.

First, the electrical field impressing roll 52 is run in rotation in a direction indicated by arrow N in FIG. 20 for sucking up a large quantity of the liquid developer 50 from the developer vessel 53 for allowing the developer to be deposited thereon. The electrical field impressing roll 52 is further run in rotation for removing an excess portion of the liquid developer 50 for forming a liquid developer layer having a thickness substantially equal to the interval between the roll 52 and the developer roll 51.

At the same time as the liquid developer layer is formed, the electrical field impressing roll 52 generates the phenomenon of electrophoresis in the charged toner particles in the liquid developer layer responsive to the difference in electrical potential across the roll 52 and the developer roll 51 for causing the charged toner particles to be migrated towards the developing roll 51. The charged toner particles in the liquid developer layer are attracted by the developer roll 51 at a lower electrical potential than that of the electrical field impressing roll 52 for forming a liquid toner layer on the developer roll 51.

The process of forming the liquid toner layer represents an example of using the first embodiment of the liquid toner layer forming step explained with reference to FIGS. 3 and 4.

The developer roll 51, on the surface of which has been formed the liquid toner layer, is further run in rotation in a direction indicated by arrow N in FIG. 20 for being contacted with the photosensitive member 55. At this time, the liquid toner layer is transcribed by the potential of the electrostatic latent image formed on the surface of the photosensitive member 55 on the surface of the photosensitive member 55. The developer image is formed on the basis of the electrostatic latent image transcribed on the photosensitive member 55.

If the above-described liquid developing method is implemented by a printer capable of representing the gradation, it is possible with the developing method employing the liquid developer to form the electrostatic latent image in which the surface electric potential on the photosensitive member 55 is changed continuously for continuously changing the thickness of the liquid toner layer deposited on the photosensitive member 55.

If the above-described liquid developing method is implemented as a bi-level printer, the liquid toner layer in its entirety is left on the developing roll 51 with a margin to form a white area, or the liquid toner layer in its entirety is deposited on the photosensitive member 55 to form a black area. The liquid developer 57 left on the electrical field impressing roll 52 and on the developer roll 51 is then scraped by the scraper 56 off the surface of the electrical field impressing roll 52 and recovered into the recovery vessel 54. The recovered liquid developing agent 50 is adjusted as to the toner particle density before re-utilization.

With the first embodiment of the developing method, as described above, the liquid developer 50 is deposited on the developing roll 51, and an electrical field is applied for forming the liquid toner layer, after which the developer roll 51 is contacted under pressure with the photosensitive member 55. The result is that the liquid toner layer is separated in a direction of the electrical field formed during pressure contact in the liquid toner layer for development, in distinction from the case of the electrophoretic development method in which the charged toner particles are migrated, thus achieving high-speed development.

With the development method employing the liquid developer, since the developer roll is contacted under pressure with the photosensitive member 55 after the liquid toner layer is formed on the developer roll 51, no excess liquid developer layer is formed on the photosensitive member 55, so that the operation of squeezing off the excess liquid developer layer, as required in the conventional electrophoretic development method, may be eliminated.

In addition, with the present development method employing the liquid developer, the liquid toner layer is separated depending on the direction of the electrical field formed in the liquid toner layer with pressure contact to effect development, if the liquid toner layer is formed on the developing roll 51, so that charged toner particles faithfully corresponding to the current density of the electrostatic latent image on the photosensitive member 55 may be developed to achieve a developer image of the uniform halftone density.

Moreover, with the developing method employing the liquid developer, it suffices if a liquid toner layer is formed on the developing roll 51, so that, even if the charged toner particles in the liquid developing agent 50 has a high density, there is no risk of pollution to the texture of the carrier or deposition of excess charged toner particles on the image area, such as are encountered in the conventional electrophoretic developing method, thus enabling the use of the liquid developing agent 50 of a higher density.

Figure 21:
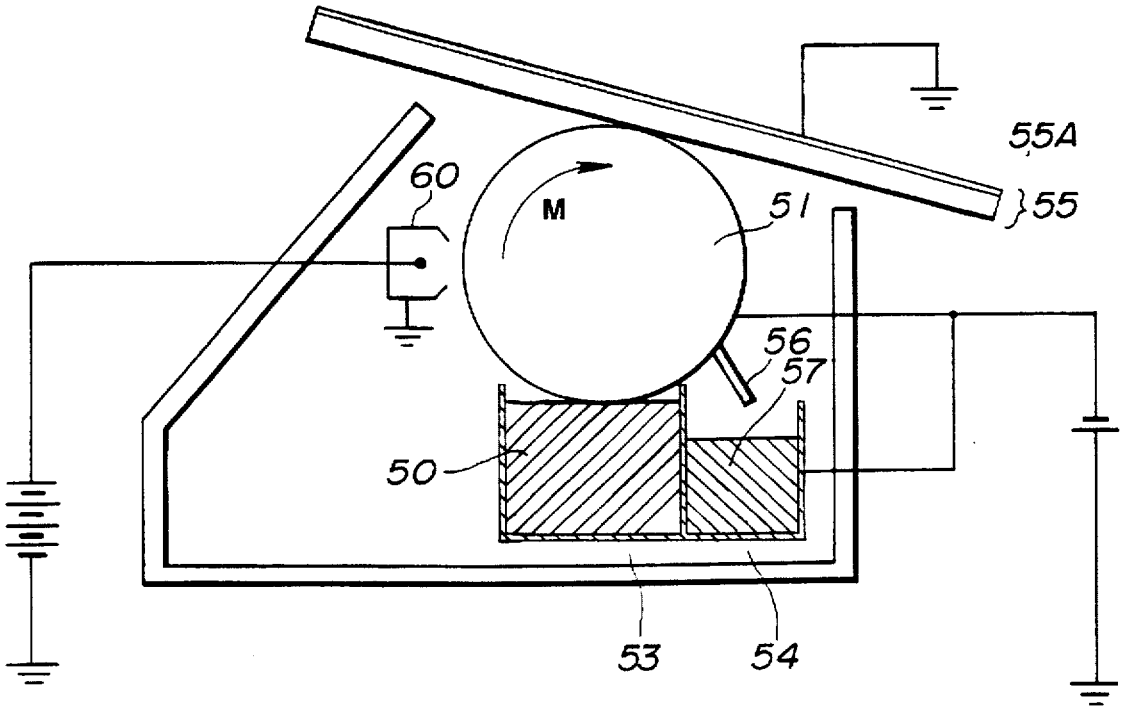
FIG. 21 illustrates a second embodiment of the development method employing a liquid developer.

Referring to FIG. 21, a second embodiment of the developing method employing the liquid developing agent is explained. The basic method, which is similar to the above-described first embodiment of the developing method, has a feature that the electrical field impressing roll 52 is not used and that the liquid developer layer deposited on the developing roll 51 is charged by corona charging, as shown in FIG. 21. In the following description, the parts or components employed in the above-described first embodiment of the developing method are denoted by the same reference numerals and the corresponding description is omitted for simplicity.

In the present developing method, employing the liquid developing agent, the developer vessel 53 is placed so that part of the peripheral surface of the developing roll 51 is directly dipped in the liquid developer 50. The electrical potential equal to that impressed across the developer roll is impressed across the developer vessel 53. With the present developing method, employing the liquid developing agent, a corona charger 60 is used for corona charging a liquid developer layer formed by deposition of the liquid developer 50 on the developer roll 51.

The corona charger 60, employed for this corona charging, is arranged in proximity to the surface of the developing roll 51 for generating positive charges on the surface of the liquid developer layer formed on the developing roll 51. The corona charger 60 has a charger housing having an opening facing the surface of the photosensitive member 55 and a discharging wire provided within the charger housing for producing corona charging.

First, the developing roll 51 is run in rotation in a direction indicated by arrow M in FIG. 21 for sucking up a large quantity of the liquid developer 50 from the developer vessel 53 for allowing the developer to be deposited thereon. The corona charger 60 then raises the voltage impressed across the discharging wire. If the electrical field exceeds a critical value, corona charging is produced from the discharging wire for generating positive charges on the surface of the liquid developer layer formed on the developer roll 51. As the developer roll 51 is run in rotation in a direction shown by arrow M in FIG. 21, the corona charger 60 uniformly charges the entire surface of the liquid developer layer formed on the developer roll 51 with positive charges. The charged toner particles in the electrified liquid developer layer are migrated towards the developer roll 51 for forming a liquid toner layer on the developer roll 51.

The process of forming the liquid toner layer represents an example of using the second embodiment of the liquid toner layer forming step explained with reference to FIGS. 5, 6 and 7.

The developer roll 51, on the surface of which has been formed the liquid toner layer, is further run in rotation in a direction indicated by arrow M in FIG. 21 for being contacted with the photosensitive member 55. At this time, the liquid toner layer is transcribed by the potential of the electrostatic latent image formed on the surface of the photosensitive member 55 on the surface of the photosensitive member 55. The developer image is formed on the basis of the electrostatic latent image transcribed on the photosensitive member 55.

If the above-described liquid developing method is implemented by a printer capable of representing the gradation, it is possible with the developing method employing the liquid developer to form the electrostatic latent image in which the surface electric potential on the photosensitive member 55 is changed continuously for continuously changing the thickness of the liquid toner layer deposited on the photosensitive member 55. If the above-described liquid developing method is implemented as a bi-level printer, the liquid toner layer in its entirety is left on the developing roll 51 with a margin to form a white area, or the liquid toner layer in its entirety is deposited on the photosensitive member 55 to form a black area.

The liquid developer 50 left on the electrical field impressing roll 52 and on the developer roll 51 is then scraped by a scraper off the surface of the electrical field impressing roll 52 and recovered into the recovery vessel 54. The recovered liquid developing agent 50 is adjusted as to the toner particle density before re-utilization.

Figure 22:
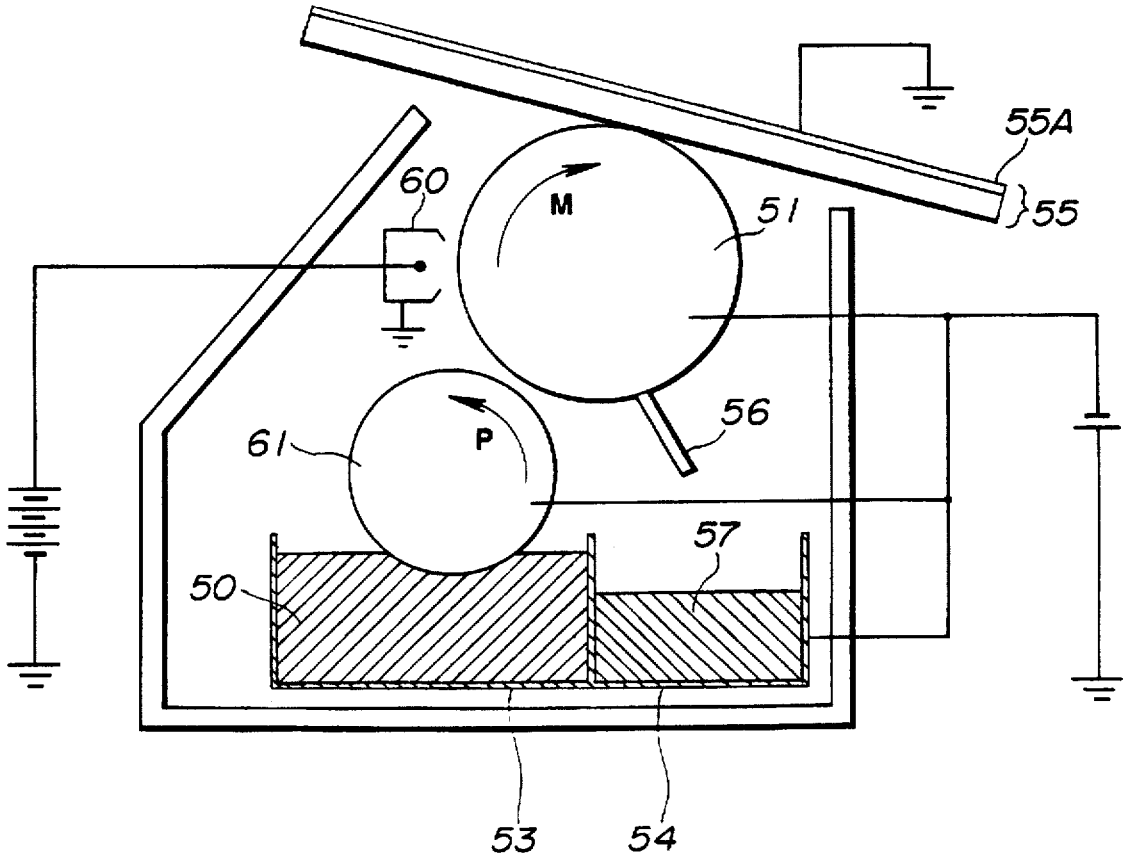
FIG. 22 illustrates a modification of the second embodiment of the development method employing a liquid developer.

In the developing method of the second embodiment, the liquid developer 50 is directly sucked onto the developing roll for forming the liquid developer layer. Alternatively, the liquid developer layer may also be formed via a supply roll 61, as shown in FIG. 22.

The electrical voltage equal to that impressed across the developer roll is impressed across the supply roll 61. The supply roll 61 is run in rotation in a direction indicated by arrow P in FIG. 20 for sucking up a large quantity of the liquid developer 50 from the developer vessel 53 for allowing the liquid developer 50 to be deposited thereon. As the supply roll 61 is further run in rotation, any excess liquid developer 50 is removed, so that a liquid developer layer substantially equal in thickness to the gap width between the roll 61 and the developer roll 51 is generated between the roll 61 and the developer roll.

With the second embodiment of the developing method, as described above, the liquid developer 50 is deposited on the developing roll, and an electrical field is applied for forming the liquid toner layer, after which the developer roll is contacted under pressure with the photosensitive member 55. The result is that the liquid toner layer is separated in a direction of the electrical field formed during pressure contact in the liquid toner layer for development, in distinction from the case of the electrophoretic development method in which the charged toner particles are migrated, thus achieving high-speed development.

With the development method employing the liquid developer, the developer roll is contacted under pressure with the photosensitive member 55 after the liquid toner layer is formed on the developer roll, no excess liquid developer layer is formed on the photosensitive member 55, so that the operation of squeezing off the excess liquid developer layer, as required in the conventional electrophoretic development method, may be eliminated.

In addition, with the present development method employing the liquid developer, the liquid toner layer is separated depending on the direction of the electrical field formed in the liquid toner layer with pressure contact to effect development, if the liquid toner layer is formed on the developing roll 51, so that charged toner particles faithfully corresponding to the current density of the electrostatic latent image on the photosensitive member 55 may be developed to achieve a developer image of the uniform halftone density.

Moreover, with the developing method employing the liquid developer, it suffices if a liquid toner layer is formed on the developing roll 51, so that, even if the charged toner particles in the liquid developing agent 50 has a high density, there is no risk of pollution to the texture or deposition of excess charged toner particles on the image area, such as are encountered in the conventional electrophoretic developing method, thus enabling the use of the liquid developing agent 50 of a higher density.

Figure 23:
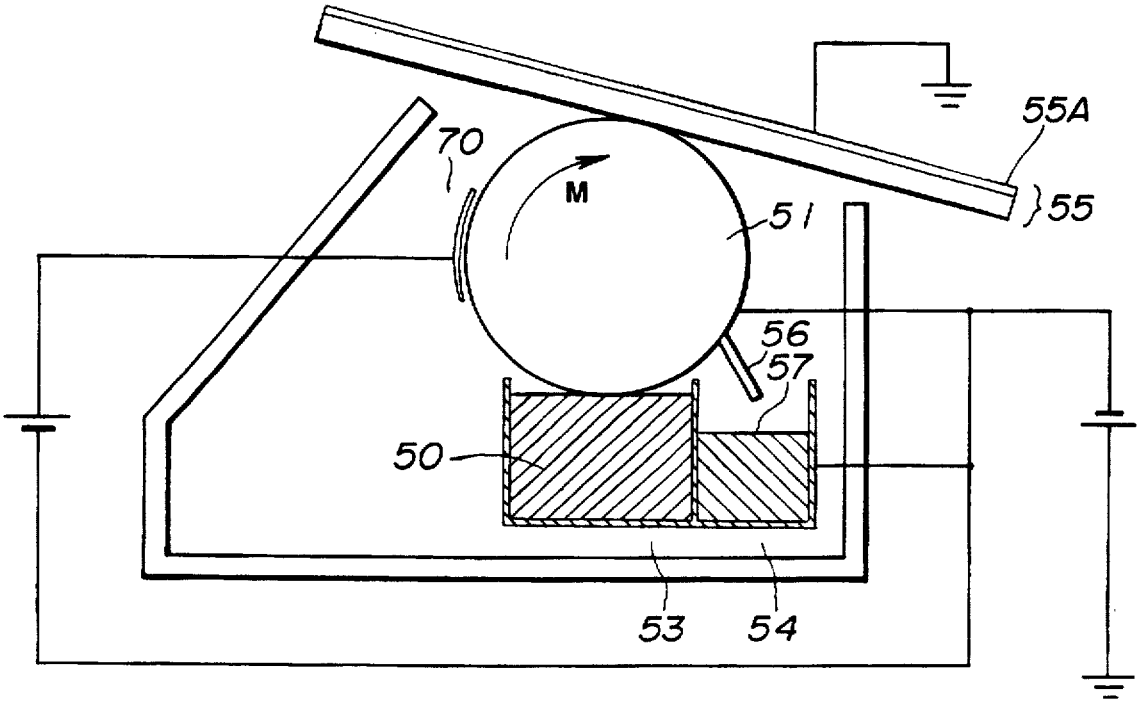
FIG. 23 illustrates a third embodiment of the development method employing a liquid developer.

Referring to FIG. 23, a second embodiment of the developing method employing the liquid developing agent is explained. The basic method, which is similar to the above-described first embodiment of the developing method, has a feature that the electrical field impressing roll 52 is not used and that an electrical field impressing terminal plate 70 is contacted with the liquid developer layer deposited on the developer roll 51 for impressing an electrical field in order to effect charging, as shown in FIG. 23. In the following description, the parts or components employed in the above-described first embodiment of the developing method are denoted by the same reference numerals and the corresponding description is omitted for simplicity.

In the present developing method, employing the liquid developing agent, the developer vessel 53 is placed so that part of the peripheral surface of the developing roll 51 is directly dipped in the liquid developer 50. The electrical potential equal to that impressed across the developer roll is impressed across the developer vessel 53. With the present developing method, employing the liquid developing agent, the electrical field impressing terminal plate 70 is contacted with the surface of a liquid developer layer formed by deposition of the liquid developer 50 on the developer roll 51.

The electrical field impressing terminal plate 70 is mounted in proximity to the developing roll 51 for defining a gap in-between for forming a meniscus of the liquid developer 50, as shown in FIG. 23. This electrical field impressing terminal plate 70 is formed of an electrically conductive material and bent in shape to conform to the peripheral surface of the developing roll 51. An electrical potential which is positive with respect to the potential of the developer roll 51 is impressed across the terminal plate 70.

The developing roll 51 is run in rotation in a direction indicated by arrow M in FIG. 23 for sucking up a large quantity of the liquid developer 50 from the developer vessel 53 for forming a liquid developer layer. The electrical field impressing terminal plate 70 is contacted in this state on the surface of the liquid developer layer on the developing roll 51. The electrical field impressing terminal plate 70 is contacted with the entire surface of the liquid developer layer formed on the developing roll 51 by the developing roll 51 being run in rotation in a direction indicated by arrow M in FIG. 23. The electrical field impressing terminal plate 70 produces the phenomenon of electrophoresis in the charged toner particles in the liquid developer layer, responsive to the difference in electrical potential across the terminal plate and the developing roll 51 for migrating the charged toner particles towards the developing roll 51. The charged toner particles are attracted by the developing roll 51 lower in electrical potential than the electrical field impressing terminal plate 70 for forming a liquid toner layer on the developing roll 51.

The process of forming the liquid toner layer represents an example of using the third embodiment of the liquid toner layer forming step explained with reference to FIGS. 8, 9 and 10.

The developer roll, on the surface of which has been formed the liquid toner layer, is further run in rotation in a direction indicated by arrow M in FIG. 23 for being contacted with the photosensitive member 55. At this time, the liquid toner layer is transcribed by the potential of the electrostatic latent image formed on the surface of the photosensitive member 55. The developer image is formed on the basis of the electrostatic latent image transcribed on the photosensitive member 55.

If the above-described liquid developing method is implemented by a printer capable of representing the gradation, it is possible with the developing method employing the liquid developer to form the electrostatic latent image in which the surface electric potential on the photosensitive member 55 is changed continuously for continuously changing the thickness of the liquid toner layer deposited on the photosensitive member 55. If the above-described liquid developing method is implemented by a printer capable of representing the gradation, it is possible with the developing method employing the liquid developer to form the electrostatic latent image in which the surface electric potential on the photosensitive member 55 is changed continuously for continuously changing the thickness of the liquid toner layer deposited on the photosensitive member 55. If the above-described liquid developing method is implemented by a printer capable of representing the gradation, it is possible with the developing method employing the liquid developer to form the electrostatic latent image in which the surface electric potential on the photosensitive member 55 is changed continuously for continuously changing the thickness of the liquid toner layer deposited on the photosensitive member 55.

If the above-described liquid developing method is implemented as a bi-level printer, the liquid toner layer in its entirety is left on the developing roll 51 with a margin to form a white area, or the liquid toner layer in its entirety is deposited on the photosensitive member 55 to form a black area.

The liquid developer 57 left on the electrical field impressing roll 52 and on the developer roll 51 is then scraped by the scraper 56 off the surface of the electrical field impressing roll 52 and recovered into the recovery vessel 54. The recovered liquid developing agent 50 is adjusted as to the toner particle density before re-utilization.

Figure 24:
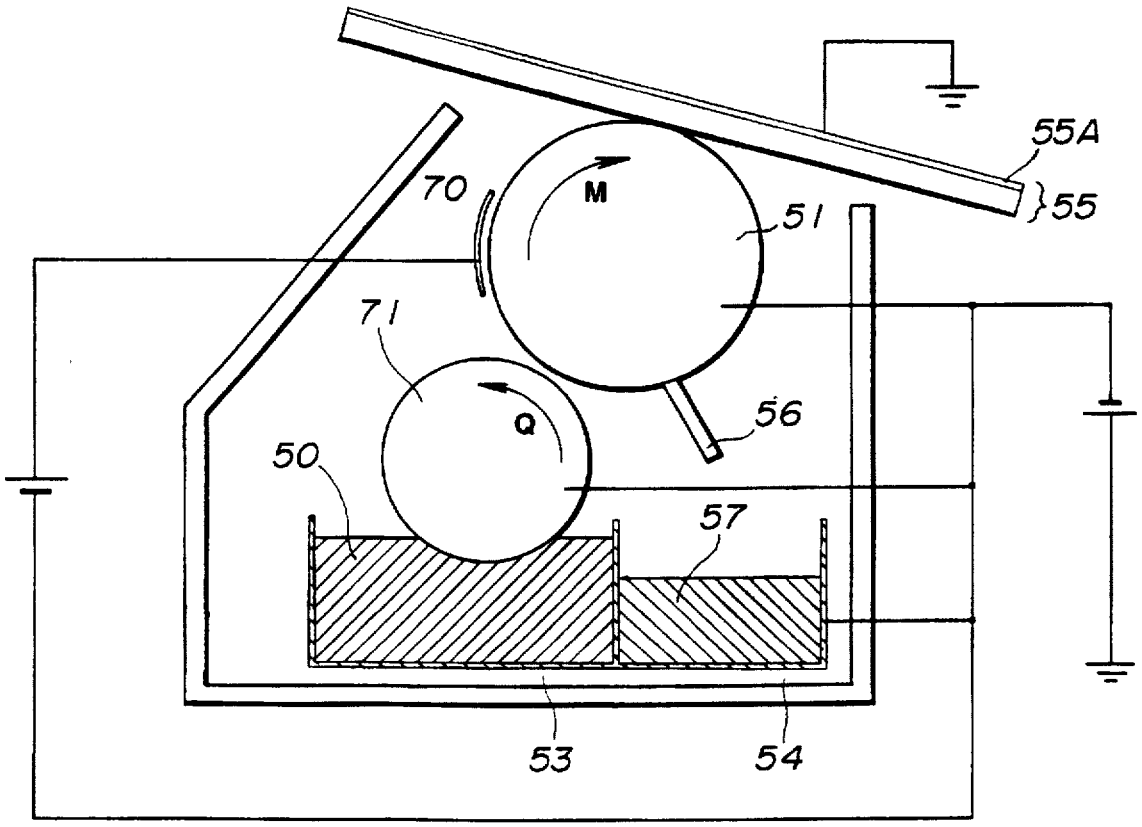
FIG. 24 illustrates a modification of the third embodiment of the development method employing a liquid developer.

In the developing method of the second embodiment, the liquid developer 50 is directly sucked onto the developing roll for forming the liquid developer layer. Alternatively, the liquid developer layer may also be formed via a supply roll 71, as shown in FIG. 24.

The electrical voltage equal to that impressed across the developer roll is impressed across the supply roll 71. The supply roll 71 is run in rotation in a direction indicated by arrow P in FIG. 24 for sucking up a large quantity of the liquid developer 50 from the developer vessel 53 for allowing the liquid developer to be deposited thereon. As the supply roll 71 is further run in rotation, any excess liquid developer 50 is removed, so that a liquid developer layer substantially equal in thickness to the gap width between the roll 71 and the developer roll is generated between the roll 71 and the developer roll.

Although the electrical field impressing terminal plate 70 is used in the present third embodiment of the development method, a rod or a roll, not shown, may also be used in place of the electrical field impressing terminal plate 70. If the roll is used, it is run in rotation in a froward direction or in a reverse direction relative to the rotational direction of the developing roll.

With the third embodiment of the developing method, as described above, the liquid developer 50 is deposited on the developing roll 51, and an electrical field is applied for forming the liquid toner layer, after which the developer roll is contacted under pressure with the photosensitive member 55. The result is that the liquid toner layer is separated in a direction of the electrical field formed during pressure contact in the liquid toner layer for development, in distinction from the case of the electrophoretic development method in which the charged toner particles are migrated, thus achieving high-speed development.

With the third embodiment of the development method, the developer roll is contacted under pressure with the photosensitive member 55 after the liquid toner layer is formed on the developer roll, no excess liquid developer layer is formed on the photosensitive member 55, so that the operation of squeezing off the excess liquid developer layer, as required in the conventional electrophoretic development method, may be eliminated.

in addition, with the present development method employing the liquid developer, the liquid toner layer is separated depending on the direction of the electrical field formed in the liquid toner layer with pressure contact in order to effect development, if the liquid toner layer is formed on the developing roll 51, so that charged toner particles faithfully corresponding to the current density of the electrostatic latent image on the photosensitive member 55 may be developed to achieve a developer image of the uniform halftone density.

Moreover, with the developing method employing the liquid developer, it suffices if a liquid toner layer is formed on the developing roll 51, so that, even if the charged toner particles in the liquid developing agent 50 has a high density, there is no risk of pollution to the carrier texture or deposition of excess charged toner particles on the image area, such as are encountered in the conventional electrophoretic developing method, thus enabling the use of the liquid developing agent 50 of a higher density.

Although the foregoing description has been made with reference to a monochromatic printer, the present invention may also be applied to a color printer.

Although the positive development method for developing the electrostatic latent image with charged toner particles of the opposite polarity to that of the latent image, it is of course possible to envisage the reverse method of developing non-charged areas of an image using toner particles charged to the opposite polarity to that of the charge carrier.

We claim:

1. A developing method employing a liquid developer comprised of charged toner particles dispersed in an electrically insulating liquid, said charged toner particles including at least a coloring agent and a resin, comprising the steps of:

(a) depositing said liquid developer to a uniform thickness on a surface of a developer carrier and impressing an electrical field across said liquid developer deposited on said surface of said developer carrier to form a liquid toner layer of charged toner particles of predominantly a single polarity assembled together; and (b) pressing a charge carrier having an electrostatic latent image formed thereon onto said liquid toner layer formed on said developer carrier and establishing a potential difference between said developer carrier and said charge carrier to effect development of said image, wherein said developed image requires no removal of excess toner therefrom.

2. The developing method as claimed in claim 1, wherein in said step (a) said charged toner particles migrate by electrophoresis under said electrical field impressed across said developer carrier such that said charged toner particles of predominantly said single polarity assemble together in said liquid toner layer.

3. The developing method as claimed in claim 1, wherein in said step (a) said electrical field is impressed by a corona charger.

4. The developing method as claimed in claim 1, wherein in said step (a) an electrical voltage is applied across one or more electrodes placed in proximity to said developer carrier to establish said electrical field.

5. The developing method as claimed in claim 1, wherein said charged toner particles are dispersed in said electrically insulating liquid comprising an organic solvent, and said charged toner particles of predominantly said single polarity are charged to a positive or negative polarity.

6. The developing method as claimed in claim 1, wherein said electrostatic latent image is formed on a photosensitive layer provided at a surface of said charge carrier.

7. The developing method as claimed in claim 1, wherein in said step (b) said liquid toner layer is left on said developer carrier and/or transcribed to said charge carrier based on an electrical potential of said electrostatic latent image.

8. The developing method as claimed in claim 7, wherein in said step (b) said liquid toner layer is left on said developer carrier and/or transcribed to said charge carrier according to:

$$-Vp+V2=V1-Vb,$$

where −Vp represents an electrical potential of said electrostatic latent image, −Vb represents said potential difference between said developer carrier and said charge carrier, V1 represents an electrical potential of a first sublayer of said liquid toner layer adjacent said developer carrier, and V2 represents an electrical potential of a second sublayer of said liquid toner layer adjacent said charge carrier.

* * * * *